US007540384B2

(12) United States Patent
Ness et al.

(10) Patent No.: US 7,540,384 B2
(45) Date of Patent: Jun. 2, 2009

(54) APPARATUS AND METHOD OF SEPARATING AND CONCENTRATING ORGANIC AND/OR NON-ORGANIC MATERIAL

(75) Inventors: Mark A Ness, Underwood, ND (US); Matthew P Coughlin, Hibbing, MN (US); Edward K Levy, Bethleham, PA (US); Nenad Sarunac, Easton, PA (US); John M. Wheeldon, Birmingham, AL (US)

(73) Assignee: Great River Energy, Elk River, MN (US)

( * ) Notice: Subject to any disclaimer, the term of this patent is extended or adjusted under 35 U.S.C. 154(b) by 394 days.

(21) Appl. No.: 11/199,743

(22) Filed: Aug. 8, 2005

(65) Prior Publication Data

US 2006/0199134 A1 Sep. 7, 2006

Related U.S. Application Data

(63) Continuation-in-part of application No. 11/107,153, filed on Apr. 15, 2005, now Pat. No. 7,275,644.

(60) Provisional application No. 60/618,379, filed on Oct. 12, 2004.

(51) Int. Cl.
*B07B 4/00* (2006.01)
*B07B 7/00* (2006.01)

(52) U.S. Cl. ..... 209/134; 209/133; 209/143; 209/147

(58) Field of Classification Search ..... 209/133, 209/134, 143, 147
See application file for complete search history.

(56) References Cited

U.S. PATENT DOCUMENTS

| | | | | |
|---|---|---|---|---|
| 2,512,422 | A | 6/1950 | Fletcher et al. | |
| 2,671,968 | A | 3/1954 | Criner | |
| 3,007,577 | A | 11/1961 | Putman | |
| 3,090,131 | A | 5/1963 | Waterman, Jr. | |
| 3,238,634 | A | 3/1966 | Groins | |
| 3,331,754 | A | 7/1967 | Mansfield | |
| 3,409,131 | A * | 11/1968 | Petersen et al. | 209/143 |
| 3,434,932 | A | 3/1969 | Mansfield | |
| 3,471,016 | A | 10/1969 | Everson et al. | |
| 3,539,001 | A | 11/1970 | Binnex et al. | |
| 3,687,431 | A | 8/1972 | Parks | |

(Continued)

OTHER PUBLICATIONS

Doell, Glenn "Dais-Analytic Corporation: An Energy Technology Company," (Mar. 22, 2001).

(Continued)

*Primary Examiner*—Patrick H Mackey
*Assistant Examiner*—Terrell H Matthews
(74) *Attorney, Agent, or Firm*—Moss & Barnett

(57) ABSTRACT

An apparatus for segregating particulate by density and/or size including a fluidizing bed having a particulate receiving inlet for receiving particulate to be fluidized. The fluidized bed also includes an opening for receiving a first fluidizing stream, an exit for fluidized particulate and at least one exit for non-fluidized particulate. A conveyor is operatively disposed in the fluidized bed for conveying the non-fluidized particulate to the non-fluidized particulate exit. A collector box is in operative communication with the fluidized bed to receive the non-fluidized particulate. There is a means for directing a second fluidizing stream through the non-fluidized particulate as while it is in the collector box to separate fluidizable particulate therefrom.

42 Claims, 25 Drawing Sheets

U.S. PATENT DOCUMENTS 3,687,743 A 8/1972 Parks
3,728,230 A 4/1973 Kemmetmueller
3,800,427 A 4/1974 Kemmetmueller
3,842,461 A * 10/1974 Wurster ..... 15/326
3,852,168 A 12/1974 Oetiker
3,960,513 A 6/1976 Agarwal et al.
3,968,052 A * 7/1976 Seglin et al. ..... 252/373
4,028,228 A 6/1977 Ferris et al.
4,053,364 A 10/1977 Poersch et al.
4,073,481 A 2/1978 Lawson et al.
4,100,033 A 7/1978 Holter
4,152,843 A 5/1979 Kemmetmueller
4,174,946 A 11/1979 Rohde
4,176,011 A 11/1979 Knappstein
4,192,650 A 3/1980 Seitzer
4,196,676 A * 4/1980 Brown et al. ..... 110/245
4,230,559 A * 10/1980 Smith ..... 209/139.1
4,236,318 A 12/1980 Heard et al.
4,240,877 A 12/1980 Stahlherm et al.
4,245,395 A 1/1981 Potter
4,253,821 A 3/1981 Bradshaw
4,253,825 A 3/1981 Fasano
4,266,539 A 5/1981 Parker et al.
4,280,418 A 7/1981 Erhard
4,284,416 A 8/1981 Nahas
4,284,476 A 8/1981 Wagener et al.
4,292,742 A 10/1981 Ekberg
4,294,807 A 10/1981 Randolph
4,295,281 A * 10/1981 Potter ..... 34/371
4,299,694 A * 11/1981 Goodell ..... 209/139.1
4,300,291 A 11/1981 Heard et al.
4,308,102 A 12/1981 Wagener et al.
4,310,501 A * 1/1982 Reh et al. ..... 423/484
4,324,544 A 4/1982 Blake
4,331,445 A 5/1982 Burns
4,338,160 A 7/1982 Dellessard et al.
4,354,903 A 10/1982 Weber et al.
4,409,101 A * 10/1983 Salikhov et al. ..... 210/266
4,430,161 A 2/1984 Petrovic et al.
4,431,485 A 2/1984 Petrovic et al.
4,436,589 A 3/1984 Petrovic et al.
4,440,625 A 4/1984 Go et al.
4,444,129 A 4/1984 Ladt
4,449,483 A 5/1984 Strohmeyer
4,468,288 A 8/1984 Galow et al.
4,470,878 A 9/1984 Petrovic et al.
4,481,724 A 11/1984 Petrovic et al.
4,493,157 A 1/1985 Wicker
4,495,710 A 1/1985 Ottoson
4,506,608 A 3/1985 Strohmeyer, Jr.
4,523,388 A 6/1985 Cuel
4,530,700 A 7/1985 Sawyer et al.
4,533,438 A 8/1985 Michael et al.
4,567,674 A 2/1986 Strohmeyer, Jr.
4,571,174 A 2/1986 Shelton
4,574,744 A 3/1986 Lorenz et al.
4,575,418 A 3/1986 Robbins
4,606,793 A 8/1986 Petrovic et al.
4,617,744 A 10/1986 Siddoway et al.
4,635,379 A 1/1987 Kroneld
4,644,664 A 2/1987 Bradshaw
4,655,436 A 4/1987 Williams
4,668,255 A 5/1987 Govind
4,736,711 A 4/1988 Marlair et al.
4,754,869 A * 7/1988 Hutchison et al. ..... 198/536
4,795,037 A 1/1989 Rich, Jr.
4,809,537 A 3/1989 Glover et al.
4,822,383 A 4/1989 Brose et al.
4,842,695 A 6/1989 Schmid et al.
4,882,274 A 11/1989 Pyne, Jr. et al.
4,888,885 A 12/1989 Caughey
4,957,049 A 9/1990 Strohmeyer, Jr.
5,024,681 A 6/1991 Chang
5,033,208 A 7/1991 Ohno et al.
5,035,721 A 7/1991 Atherton
5,087,269 A 2/1992 Cha et al.
5,087,351 A 2/1992 Vallentine, Sr.
5,103,743 A 4/1992 Berg
5,120,431 A * 6/1992 Cordonnier ..... 209/135
5,145,489 A 9/1992 Dunlop
5,158,580 A 10/1992 Chang
5,171,406 A * 12/1992 Shang et al. ..... 201/31
5,192,398 A 3/1993 Kress et al.
5,197,398 A 3/1993 Levy et al.
5,244,099 A * 9/1993 Zaltzman et al. ..... 209/466
5,283,959 A 2/1994 Nagayoshi et al.
5,299,694 A 4/1994 Rambaud
5,322,530 A 6/1994 Merriam et al.
5,327,717 A 7/1994 Hauk
5,361,513 A 11/1994 Woessner
5,372,791 A 12/1994 Abdulally
5,373,648 A 12/1994 Wolf
5,399,194 A 3/1995 Cochran et al.
5,403,365 A 4/1995 Merriam et al.
5,426,932 A 6/1995 Morihara et al.
5,430,270 A 7/1995 Findlan et al.
5,471,955 A 12/1995 Dietz
5,491,969 A 2/1996 Cohn et al.
5,501,162 A 3/1996 Kravets
5,503,646 A 4/1996 McKenny et al.
5,527,365 A 6/1996 Colemann et al.
5,534,137 A 7/1996 Griggs et al.
5,537,941 A 7/1996 Goldich
5,546,875 A 8/1996 Selle et al.
5,547,549 A 8/1996 Fracas
5,601,703 A 2/1997 Szymocha et al.
5,637,336 A 6/1997 Kannenberg et al.
5,683,494 A 11/1997 Altman et al.
5,827,352 A 10/1998 Altman et al.
5,830,246 A 11/1998 Dunlop
5,830,247 A 11/1998 Dunlop
5,832,848 A 11/1998 Reynoldson et al.
5,853,548 A * 12/1998 Piskorz et al. ..... 201/7
5,858,035 A 1/1999 Dunlop
5,867,921 A 2/1999 Maruyama et al.
5,904,741 A 5/1999 Dunlop et al.
5,948,143 A 9/1999 Sjostrom et al.
5,961,693 A 10/1999 Altman et al.
5,996,808 A 12/1999 Levy et al.
6,096,118 A 8/2000 Altman et al.
6,162,265 A 12/2000 Dunlop et al.
6,302,945 B1 10/2001 Altman et al.
6,355,094 B1 3/2002 Schomaker et al.
6,422,392 B1 7/2002 Levy
6,447,559 B1 9/2002 Hunt
6,488,740 B1 * 12/2002 Patel et al. ..... 95/71
6,500,241 B2 12/2002 Reddy
6,547,854 B1 4/2003 Gray et al.
6,755,892 B2 6/2004 Nalette et al.
6,783,739 B2 8/2004 Altman
6,789,488 B2 9/2004 Levy et al.
7,237,679 B1 * 7/2007 Hendrickson et al. ..... 209/638

OTHER PUBLICATIONS

Bullinger, et al. "Coal Drying Improves Performance and Reduces Emissions," *27th International Technical Conference on Coal Utilization and Fuel Systems* (Clearwater, FL) (Mar. 4-7, 2002).

Sarunac, et al. "Coal Drying Improves Performance and Reduces Emissions," *EPRI Heat Rate Improvement Conference* (Birmingham, AL) (Jan. 2003).

Bullinger, Charles "Fuel Enhancement by Incremental Moisture Reduction," *18th International Low Rank Coal* (Jun. 25, 2003).

Ness, et al. "Pilot Coal Dryer Testing Summary," *TMRA Clean Coal Technology Workshop* (Feb. 5, 2004).
Ness, et al. "Pilot Fluidized Bed Coal Dryer: Operating Experience and Preliminary Results," *29th International Technical Conference on Coal Utilization & Fuel Systems* (Apr. 18-22, 2004).
Levy, et al. *Upgrading Low-Rank Coals Symposium* (May 2, 2004).
Ness, et al. "Pilot Fluidized Bed Coal Dryer: Operating Experience and Preliminary Results," *19th Western Fuels Symposium* (Billings, MT) (Oct. 12-14, 2004).
Sarunac, et al. "Impact of Coal Drying on Power Plant Efficiency, Operation and Emissions," *30th International Technical Conference on Coal Utilization and Fuel Systems* (Clearwater, FL) (Apr. 2005).
Sarunac, et al. "Comparison of Various Coal Drying Process Layouts and Their Impact on Plant Efficiency, Operation and Emissions," *30th International Technical Conference on Coal Utilization and Fuel Systems* (Clearwater, FL) (Apr. 2005).
Levy, et al. "The Impact of Coal Drying on Low Rank Coal Fired Power Plants," *Lexington, KY Conference* (May 2005).
Lehigh University "Performance and Emissions: Key Factors in Today's Competitive Energy Market" *Bethleham, PA Conference* (May 25-26, 2005).
Merriam, Norman W. "Removal of Mercury from Powder River Basin Coal by Low-Temperature Thermal Treatment," *Report Under DOE CRADA Filed By Western Research Institute* (Jul. 1993).
James, Dennis R. "Lignite Fuel Enhancement: Incremental Reduction Project (Phase I) Revision I," *1st NDIC Grant Application* (Feb. 14, 2000).
Dr. Moen, et al. "Lignite Coal Dryer Project (for Great River Energy, Coal Creek Station)," *Report* (May 12, 2000).
James, Dennis R. "Lignite Fuel Enhancement: Incremental Reduction Project (Phase I)," *Status Report* No. 2 (Aug. 10, 2000).
Bullinger, Charlie "Lignite Fuel Enhancement (Maximizing the Value (i.e., Lowest Cost of Electricity Produced and Reduced Emissions) of Lignite Fuel Through Incremental Moisture Reduction," *DOE Project Proposal* (Apr. 19, 2001).
Bullinger, Charlie "Lignite Fuel Enhancement: (Significantly Enhancing the Value of U.S. Lignite Fuel Its Abundant, Low-Cost and Environmentally Responsible)," *DOE Project Proposal* (Apr. 19, 2001).
Scheffknecht, Gunter "Technologies for Efficient Utilization of Low-Rank Fuels," (May 17-18, 2001).
James, Dennis R. "Lignite Fuel Enhancement: Incremental Moisture Reduction," *Final Report for Phase 1* (Dec. 14, 2001).
Kakaras, et al. "Computer Simulation Studies for the Integration of an External Dryer into a Greek Lignite-Fired Power Plant," 81 *Fuel* 583-93 (2002).
Kravetse, A. "Enhanced Rankine Cycle-Significant Reduction in NOx Emissions and Heat Rate in Both Existing and New Coal Fired Power Plants" (Unknown).
Bullinger, Charlie "Lignite Fuel Enhancement" *Project Proposal* (Jul. 31, 2002).
"Research Demonstrates Benefits of Drying Western Coal," *Lehigh Energy Update*, vol. 20(2) (Aug. 2002).
"Increasing Power Plant Efficiency-Lignite Fuel Enhancement," *DOE Project Facts Website* (May 20, 2003).
Levy, Edward K. "Use of Coal Drying to Reduce Water Consumed in Pulverized Coal Power Plants," *First Quarterly Report to DOE* (Mar. 2003).
Ness, Mark "Lignite Fuel Enhancement: Incremental Moisture Reduction Program Phase II Oct. 2003 Status Report," (Oct. 24, 2003).
Feeley et al. "Innovative Approaches and Technologies for Improved Power Plant Water Management," *U.S. DOE Program Facts* (Jan. 1, 2004).
Levy, et al. "Use of Coal Drying to Reduce Water Consumed in Pulverized Coal Power Plants," *Fourth Quarterly Report to DOE* (Jan. 1, 2004).
Levy, Edward "Performance Evaluation of Coal Creek Pilot Dryer," *Prepared for Mark Ness of GRE for Coal Creek Station* (Feb. 6, 2004).
Thwing, Theo "Lehigh Research Aids Power Plants," *The Brown and White* (*Lehigh Student Newspaper*) (Feb. 8, 2004).
Ness, Mark "Lignite Fuel Enhancement: Incremental Moisture Reduction Program Phase II Feb. 2004 Status Report," (Feb. 29, 2004).
Levy, et al. "Use of Coal Drying to Reduce Water Consumed in Pulverized Coal Power Plants," *Fifth Quarterly Report to DOE* (Apr. 1, 2004).
Levy, et al. "Separation of Ash From Lignite in a Bubbling Fluidized Bed," *Presented for Mark Ness of GRE for Coal Creek Station* (Apr. 23, 2004).
Levy, et al. "Use of Coal Drying to Reduce Water Consumed in Pulverized Coal Power Plants," *Sixth Quarterly Report to DOE* (Jul. 1, 2004).
Guffey, et al. "Thermal Pretreatment of Low-Ranked Coal for Control of Mercury Emissions," 85 *Fuel Processing Technology* 521-31 (2004).
Weinstein, et al. "Lignite Fuel Enhancement: Incremental Moisture Reduction," *Memorandum*.
Levy, et al. "Use of Coal Drying to Reduce Water Consumed in Pulverized Coal Power Plants," *Seventh Quarterly Report to DOE* (Oct. 2004).
Ness, Mark "Pilot Fluidized Bed Coal Dryer: Test 48, 49, 50, 52, 57, 58, and 59 Results," (Dec. 26, 2004).
Dubrovich, Matthew "Ash Separation From Lignite Using a Bubbling Fluidized Bed," *Thesis Paper Presented to the Graduate and Research Committee of Lehigh University* (Jan. 21, 2005).
Ness, Mark "Lignite Fuel Enhancement: Incremental Moisture Reduction Program Phase II Mar. 2005 Final Report," *Report to NDIC* (Mar. 31, 2005).
Armor, Tony "Interest Group on Drying of Wet Fuels Using Waste Heat," (Uknown).
Niro, Inc., "Fluid Bed Processing Systems," http://www.niroinc.com/html/drying/fluidbed.html (Unknown).
Niro, Inc., "Particulate Processing: Fluid Bed Processors," http://niroinc.com/html/drying/fluidbed.html (2001).

* cited by examiner

Moist Air + Elutriated Fines
166
169
Hot Condenser Cooling Water In
252
Cold Condenser Cooling Water Out
DRIED COAL
168
266
Weir 2
Stream 3
270
WASTE PROCESS
HEAT
212

FLUIDIZED BED DRYER
250
Freeboard region 162
264
Fluidized Bed
154
156
256 2nd-Stage
Plenum
152
FAN
200
AMBIENT AIR
160
164
262
Weir 1
Stream 2
268
Stream 1
260
EXTERNAL
HEAT EXCHANGER
210
WET COAL
12
258
254
1st-Stage
Hot Condenser Cooling Water In
222
Cold Condenser Cooling
Water Out
234

Schematic of the Pilot Plant

APPARATUS AND METHOD OF SEPARATING AND CONCENTRATING ORGANIC AND/OR NON-ORGANIC MATERIAL

CROSS-REFERENCE TO RELATED APPLICATION

This application is a continuation-in-part of U.S. Ser. No. 11/107,153 filed on Apr. 15, 2005, now U.S. Pat. No. 7,275,644 which claims the benefit of U.S. provisional application Ser. No. 60/618,379 filed on Oct. 12, 2004, which are hereby incorporated in their entirety by reference.

FIELD OF THE INVENTION

This invention relates to an apparatus for and method of separating particulate material from denser and/or larger material containing contaminants or other undesirable constituents, while concentrating the denser and/or larger material for removal and further processing or disposal. More specifically, the invention utilizes a scrubber assembly in operative communication with a fluidized bed that is used to process coal or another organic material in such a manner that the denser and/or larger material containing contaminates or other undesirable constituent is separated from the rest of the coal or other organic material.

BACKGROUND OF THE INVENTION

About 63% of the world's electric power and 70% of the electric power produced in the United States is generated from the burning of fossil fuels like coal, oil, or natural gas at electric power plants. Such fuel is burned in a combustion chamber at the power plant to produce heat used to convert water in a boiler to steam. This steam is then superheated and introduced to huge steam turbines whereupon it pushes against the fanlike blades of the turbine to rotate a shaft. This spinning shaft, in turn, turns the rotor of an electric generator to produce electricity.

Eighty-nine percent of the coal mined in the United States is used as the heat source for electric power plants. Unlike petroleum and natural gas, the available supplies of coal that can be economically extracted from the earth are plentiful. Bituminous coals have been the most widely used rank of coal for electric power production because of their abundance and relatively high heating values. However, they also contain medium to high levels of sulfur. As a result of increasingly stringent environmental regulations like the Clean Air Act in the U.S., electric power plants have had to install costly scrubber devices in the smokestacks of these plants to prevent the sulfur dioxide ("$SO_2$"), nitrous oxides ("$NO_x$"), and fly ash that result from burning these coals to pollute the air.

Lower rank coals like subbituminous and lignite coals have gained increasing attention as heat sources for power plants because of their low sulfur content. However, they still produce sufficient levels of $SO_2$, $NO_x$, and fly ash when burned such that treatment of the flue gas is required to comply with federal and state pollution standards. Additionally, ash and sulfur are the chief impurities appearing in coal. The ash consists principally of mineral compounds of aluminum, calcium, iron, and silicon. Some of the sulfur in coal is also in the form of minerals—particularly pyrite, which is a compound of iron and sulfur. The remainder of the sulfur in coal is in the form of organic sulfur, which is closely combined with the carbon in the coal.

Coal mining companies typically clean their coal products to remove impurities before supplying them to end users like electric power plants and coking production plants. After sorting the pieces of coal by means of a screening device to form coarse, medium, and fine streams, these three coal streams are delivered to washing devices in which the coal particles are mixed with water. Using the principle of specific gravity, the heaviest pieces containing the largest amounts of impurities settle to the bottom of the washer, whereupon they drop into a refuse bin for subsequent disposal. The cleaned coal particles from the three streams are then combined together again and dried by means of vibrators, jigs, or hot-air blowers to produce the final coal product ready for shipment to the end user.

While the cleaning process employed by coal mining operations removes much of the ash from the coal, it has little effect on sulfur, since the organic sulfur is closely bound to the carbon within the coal. Thus, other methods can be used to further purify the coal prior to its combustion. For example, the coal particles may be fed into a large machine, wherein they are subjected to vibration and pulsated air currents. U.S. Pat. No. 3,852,168 issued to Oetiker discloses such a method and apparatus for separating corn kernels from husk parts. U.S. Pat. No. 5,244,099 issued to Zaltzman et al., on the other hand, teaches the delivery of granular materials through an upwardly inclined trough through which a fluidizing gas is forced from the bottom of the trough to create a fluidized material bed. A vertical oscillatory motion is also imparted to the trough to assist in the separation of the various components contained in the material mixture. Less dense components of the mixture rise to the surface of the fluidized bed, while the denser components settle to the bottom. At the output end of the trough, a stream splitter can be used to recover different layers of materials. This apparatus is good for separating agricultural products and sand.

It is known in the prior art that under some circumstances a fluidized bed may be used without the addition of mechanical vibration or vertical oscillation to achieve particle separation. For example, U.S. Pat. No. 4,449,483 issued to Strohmeyer uses a heated fluidized bed dryer to treat municipal trash and remove heavier particles like glass from the trash before its combustion to produce heat. Meanwhile, U.S. Pat. No. 3,539,001 issued to Binnix et al. classifies materials from an admixture by means of intermediate selective removal of materials of predetermined sizes and specific gravities. The material mixture travels along a downwardly sloped screen support and is suspended by upwardly directed pneumatic pulses. U.S. Pat. No. 2,512,422 issued to Fletcher et al. again uses a downwardly inclined fluidized bed with upwardly directed pulses of air, wherein small particles of coal can be separated and purified from a coal mixture by providing holes in the top of the fluidized bed unit of a sufficient cross sectional area relative to the total cross sectional area of the bed to control the static pressure level within the fluidized bed to prevent the small particles of higher specific gravity from rising within the coal bed.

The process and devices disclosed in these Strohmeyer, Binnix, and Fletcher patents, however, all seem to be directed to the separation of different constituents within an admixture having a relatively large difference in specific gravity. Such processes may work readily to separate nuts, bolts, rocks, etc. from coal, however, they would not be expected to separate coal particles containing organic sulfur from coal particles largely free of sulfur since the specific gravities of these two coal fractions can be relatively close.

Another air pollutant of great concern is mercury, which occurs naturally in coal. Regulations promulgated by the U.S. Environmental Protection Agency ("EPA") require coal-fired power plants to dramatically reduce the mercury levels contained in their flue gases by 2010. Major efforts within the industry have focused upon the removal of mercury from the flue gas by the use of carbon-based sorbents or optimization of existing flue gas emissions control technologies to capture the mercury. However, utilization of carbon sorbent-based serubber devices can be very expensive to install and operate. Moreover, currently existing emissions control equipment can work less well for high-rank coals (anthracite and bituminous) vs. low-rank coals (subbitumionous and lignite).

Western Research Institute has therefore developed and patented a pre-combustion thermal process for treating low-rank coals to remove the mercury. Using a two-zone reactor, the raw coal is heated in the first zone at approximately 300° F. to remove moisture which is purged from the zone with a sweep gas. The dried coal is then transferred to a second zone where the temperature is raised to approximately 550° F. Up to 70-80% of the mercury contained in the coal is volatilized and swept from the zone with a second sweep gas stream. The mercury is subsequently separated from the sweep gas and collected for disposal. See Guffey, F. D. & Bland, A. E., "Thermal Pretreatment of Low-Ranked Coal for Control of Mercury Emissions," 85 *Fuel Processing Technology* 521-31 (2004); Merriam, N. W., "Removal of Mercury from Powder River Basin Coal by Low-Temperature Thermal Treatment," Topical Report WRI-93-R021 (1993); U.S. Pat. No. 5,403,365 issued to Merriam et al.

However, this pre-combustion thermal pretreatment process is still capital-intensive in that it requires a dual zone reactor to effectuate the drying and mercury volatilization steps. Moreover, an energy source is required to produce the 550° F. bed temperature. Furthermore, 20-30% of the mercury cannot be removed from the coal by this process, because it is tightly bound to the carbon contained in the coal. Thus, expensive scrubber technology will still be required to treat flue gas resulting from combustion of coal pretreated by this method because of the appreciable levels of mercury remaining in the coal after completion of this thermal pretreatment process.

Therefore, the ability to pre-treat particulate material like coal with a fluidized bed operated at a very low temperature without mechanical or chemical additives in order to separate and remove most of the pollutant constituents within the coal (e.g., mercury and sulfur) would be desirable. Such a process could be applied to all ranks of coal, and would alleviate the need for expensive scrubber technology for treatment flue gases after combustion of the coal.

SUMMARY OF THE INVENTION

The present invention includes an apparatus for segregating particulate material by density and/or size and concentrating pollutants or other undesirable constituents for separation from the particulate material feed. The apparatus includes a fluidizing bed having a receiving inlet for receiving the particulate material to be fluidized. The fluidized bed also includes an opening for receiving a first fluidizing stream, which can be a primary heat stream, a secondary heat stream, at least one waste stream, or any combination thereof. At least one discharge outlet is provided on the fluidized bed for discharging the desirable fluidized particulate stream, as well as at least one discharge outlet for discharging the non-fluidized particulate stream containing a concentration of the pollutant or other undesirable constituents. A conveyor is operatively disposed within the fluidized bed for conveying the non-fluidized particulates to the non-fluidized particulate discharge outlet. A collector box is in operative communication with the fluidized bed for receiving the discharged non-fluidized particulate material stream. There is also an optional means within the collector box for directing a second fluidizing stream through the non-fluidized particulate material while it is in the collector box in order to further concentrate from the pollutants or other undesirable constituents therein.

One advantage of the present invention is that it permits generally continuous processing of the particulate material. As the non-fluidized particulate stream is discharged from the fluidized bed to the collector box, more particulate material feed can be added to the fluidized bed for processing.

Another advantage of the present invention is a generally horizontal conveyance of the non-particulate material. This generally horizontal conveyance of the non-fluidized particulate material ensures that all of the particulate material is processed evenly and quickly by mixing or churning the material while it is being conveyed.

Yet another advantage of the present invention is that it permits the segregation of contaminants and their removal from a particulate material feed. This can provide a significant environmental benefit for an industrial plant operation.

Still yet another advantage of the present invention is that it includes a second fluidizing step or apparatus to capture more non-contaminated fluidizable particulates that are still trapped, or have become trapped, in the non-fluidized particulate material. Capturing more of the fluidized particulate increases the amount of usable non-contaminated particulates, while reducing the amount of contaminated particulates that will be subject to further processing or disposal. By capturing more of the usable non-contaminated particulates and reducing the amount of contaminated particulate material, a company is able to increase its efficiency while reducing its costs.

Figure 1:
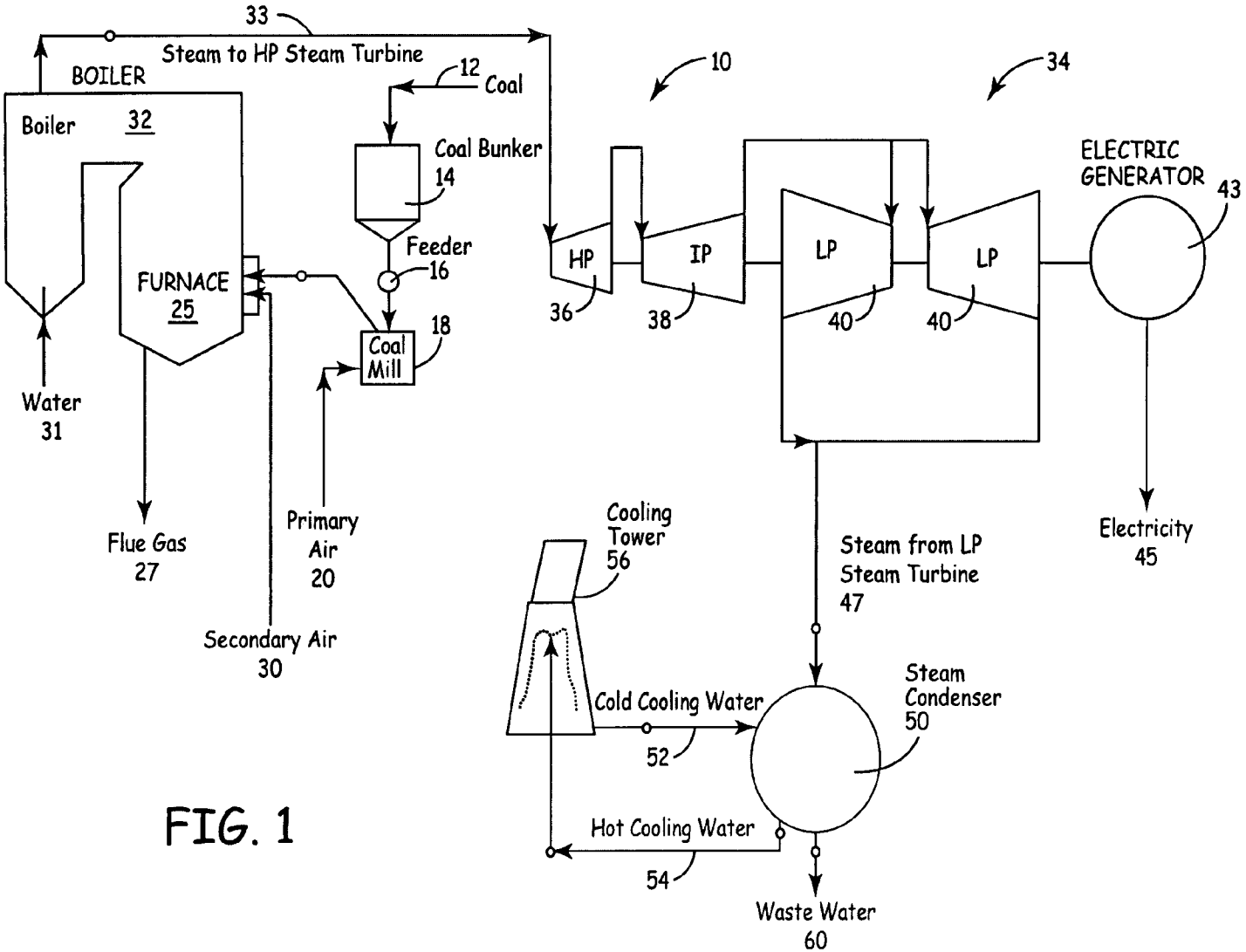
FIG. 1 is a schematic diagram illustrating a simplified coal-fired power plant operation for producing electricity.

The foregoing summary and are provided for example purposes only and are amenable to various modifications and arrangements that fall within the spirit and scope of the present invention. Therefore, the figures should not be considered limiting, but rather as a supplement to aid one skilled in the art to understand the novel concepts that are included in the following detailed description.

DETAILED DESCRIPTION OF THE PREFERRED EMBODIMENT

The invention includes an apparatus for, and a method of, separating a particulate material feed stream into a fluidized particulate stream having reduced levels of pollutants or other undesirable constituents ("contaminants"), and a non-fluidized particulate stream formed from denser and/or larger particles having an increased concentration of the contaminants. The method of separation utilized in the present invention capitalizes on the physical characteristics of the contaminants. In particular, it capitalizes on the difference between the specific gravity of contaminated and non-contaminated material. The contaminants can be removed from a majority of the particulate material by separating and removing the denser and/or larger material in which such contaminants are concentrated. The present invention uses a fluidization method of separating the contaminated denser and/or larger material from the non-contaminated material.

Although the present invention may be used in a variety of end-use applications, such as in farming, manufacturing, or industrial plant operations, for illustrative purposes only, the invention is described herein with respect to coal-burning electric power generating plants that utilize fluidized dry beds to dry the coal feed. This is not meant to limit in any way the application of the apparatus and method of this invention to other appropriate or desirable end-use applications outside of coal or the electric power generation industry.

For purposes of the present invention, "particulate material" means any granular or particle compound, substance, element, or ingredient that constitutes an integral input to an industrial plant operation, including but not limited to combustion fuels like coal, biomass, bark, peat, and forestry waste matter; bauxite and other ores; and substrates to be modified or transformed within the industrial plant operation like grains, cereals, malt, cocoa.

In the context of the present invention, "industrial plant operation" means any combustion, consumption, transformation, modification, or improvement of a substance to provide a beneficial result or end product. Such operation can include but is not limited to electric power plants, coking operations, iron, steel, or aluminum manufacturing facilities, cement manufacturing operations, glass manufacturing plants, ethanol production plants, drying operations for grains and other agricultural materials, food processing facilities, and heating operations for factories and buildings. Industrial plant operations encompass other manufacturing operations incorporating heat treatment of a product or system, including but not limited to green houses, district heating, and regeneration processes for amines or other extractants used in carbon dioxide or organic acid sequestration.

As used in this application, "coal" means anthracite, bituminous, subbituminous, and lignite or "brown" coals, and peat. Powder River Basin coal is specifically included.

For purposes of the present invention, "quality characteristic" means a distinguishing attribute of the particulate material that impacts its combustion, consumption, transformation, modification, or improvement within the industrial plant operation, including but not limited to moisture content, carbon content, sulfur content, mercury content, fly ash content, and production of $SO_2$ and $NO_x$, carbon dioxide, mercury oxide when burned.

As used in this application, "heat treatment apparatus" means any apparatus that is useful for the application of heat to a product, including but not limited to furnaces, dryers, cookers, ovens, incubators, growth chambers, and heaters.

In the context of the present invention, "dryer" means any apparatus that is useful for the reduction of the moisture content of a particulate material through the application of direct or indirect heat, including but not limited to a fluidized bed dryer, vibratory fluidized bed dryer, fixed bed dryer, traveling bed dryer, cascaded whirling bed dryer, elongated slot dryer, hopper dryer, or kiln. Such dryers may also consist of single or multiple vessels, single or multiple stages, be stacked or unstacked, and contain internal or external heat exchangers.

For purposes of this application "principal heat source" means a quantity of heat produced directly for the principal purpose of performing work in a piece of equipment, such as a boiler, turbine, oven, furnace, dryer, heat exchanger, reactor, or distillation column. Examples of such a principal heat source include but are not limited to combustion heat and process steam directly exiting a boiler.

As used in this application, "waste heat source" means any residual gaseous or liquid by-product stream having an elevated heat content resulting from work already performed by a principal heat source within a piece of equipment within an industrial plant operation that is used for the secondary purpose of performing work in a piece of equipment instead of being discarded. Examples of such waste heat sources include but are not limited to cooling water streams, hot condenser cooling water, hot flue or stack gas, spent process steam from, e.g., a turbine, or discarded heat from operating equipment like a compressor, reactor, or distillation column.

For purposes of this application, "contaminant" means any pollutant or other undesirable element, compound, chemical, or constituent contained within a particulate material that it is desirable to separate from or reduce its presence within the particulate material prior to its use, consumption, or combustion within an industrial plant operation.

For background purposes, FIG. 1 shows a simplified coal-fired electric power plant 10 for the generation of electricity. Raw coal 12 is collected in a coal bunker 14 and is then fed by means of feeder 16 to a coal mill 18 in which it is pulverized to an appropriate or predetermined particle size as is known in the art with the assistance of primary air stream 20. The pulverized coal particles are then fed to furnace 25 in which they are combusted in conjunction with secondary air stream 30 to produce a heat source. Flue gas 27 is also produced by the combustion reaction. The flue gas 27 is subsequently transported to the stack via environmental equipment.

This heat source from the furnace, in turn, converts water 31 in boiler 32 into steam 33, which is delivered to steam turbine 34. Steam turbine 34 may consist more fully of high pressure steam turbine 36, intermediate pressure steam turbine 38, and low pressure steam turbines 40 operatively connected in series. Steam 33 performs work by pushing against the fan-like blades connected to a series of wheels contained within each turbine unit which are mounted on a shaft. As the steam pushes against the blades, it causes both the wheels and turbine shaft to spin. This spinning shaft turns the rotor of electric generator 43, thereby producing electricity 45.

Steam 47 leaving the low-pressure steam turbines 40 is delivered to condenser 50 in which it is cooled by means of cooling water 52 to convert the steam into water. Most steam condensers are water-cooled, where either an open or closed-cooling circuit is used. In the closed-loop arrangement show in FIG. 1, the latent heat contained within the steam 47 will increase the temperature of cold cooling water 52, so that it is discharged from steam condenser 50 as hot cooling water 54, which is subsequently cooled in cooling tower 56 for recycle as cold cooling water 52 in a closed-loop arrangement. In an open-cooling circuit, on the other hand, the heat carried by cooling water is rejected into a cooling body of water (e.g., a river or a lake). In a closed-cooling circuit, by contrast, the heat carried by cooling water is rejected into a cooling tower.

Figure 2:
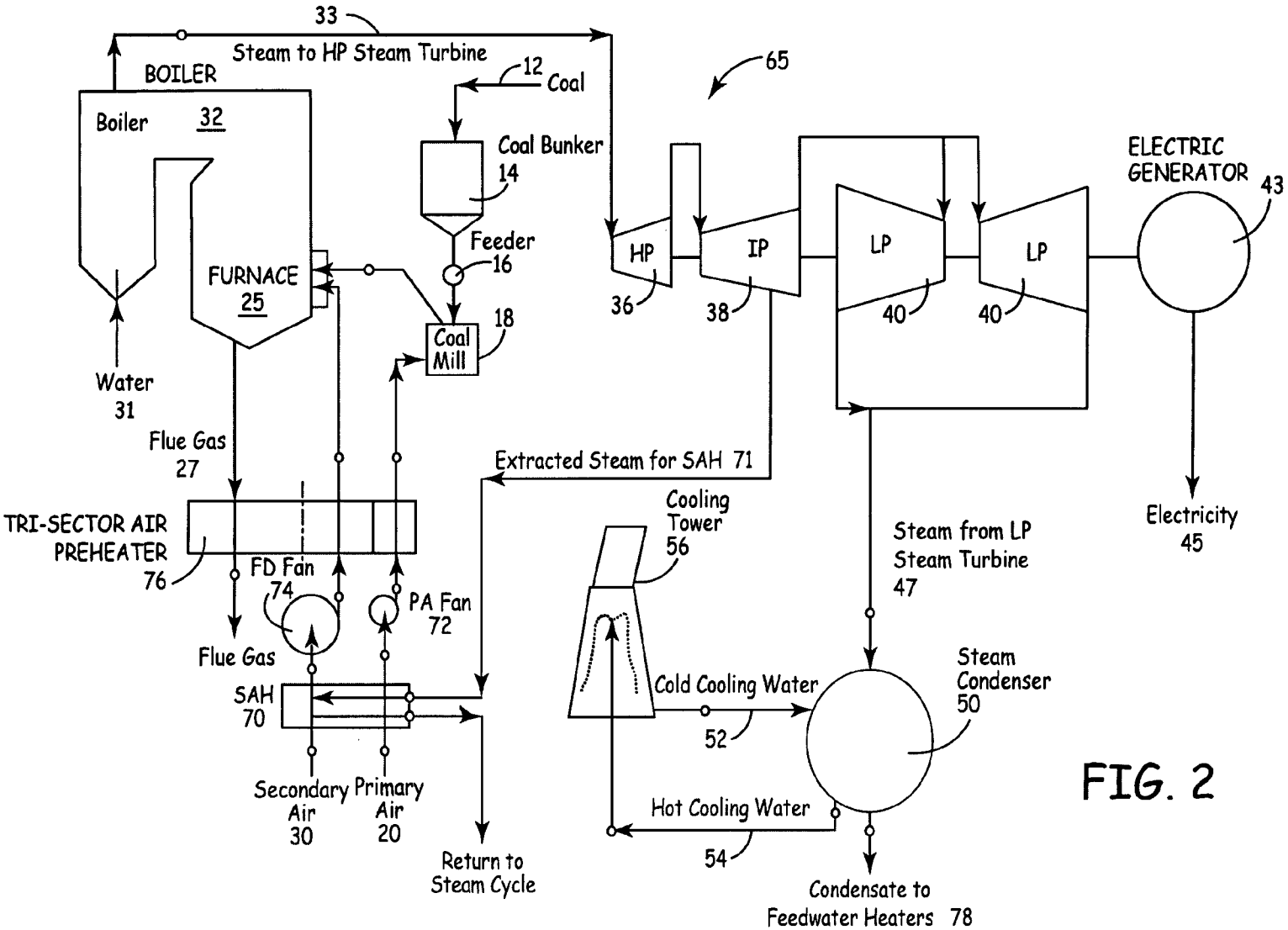
FIG. 2 is a schematic diagram showing an improved coal-fired power plant, which utilizes the flue gas and steam turbine waste heat streams to enhance the boiler efficiency.

The operational efficiency of the electric power plant 10 of FIG. 1 may be enhanced by extracting and utilizing some of the waste heat and byproduct streams of the electricity power plant, as illustrated in FIG. 2. Fossil-fired plant boilers are typically equipped with air pre-heaters ("APH") utilized to heat primary and secondary air streams used in the coal milling and burning process. Burned coal is used in a boiler system (furnace, burner and boiler arrangement) to convert water to steam, which is then used to operate steam turbines that are operatively connected to electrical generators. Heat exchangers, often termed steam-to-air pre-heaters ("SAH"), use steam extracted from the steam turbine to preheat these primary and secondary air streams upstream of the air pre-heater. Steam extraction from the turbine results in a reduced turbine (and plant) output and decreases the cycle and unit heat rate.

A typical APH could be of a regenerative (Ljungstrom or Rothemule) or a tubular design. The SAHs are used to maintain elevated temperature of air at an APH inlet and protect a cold end of the APH from corrosion caused by the deposition of sulfuric acid on APH heat transfer surfaces, and from plugging which results in an increase in flow resistance and fan power requirements. A higher APH inlet air temperature results in a higher APH gas outlet temperature and higher temperature of APH heat transfer surfaces (heat transfer passages in the regenerative APH, or tubes in a tubular APH) in the cold end of the APH. Higher temperatures reduce the acid deposition zone within the APH and also reduce the acid deposition rate.

Thus, within the modified system 65, SAH 70 uses a portion 71 of the spent process steam extracted from intermediate-pressure steam turbine 38 to preheat primary air stream 20 and secondary air stream 30 before they are delivered to coal mill 18 and furnace 25, respectively. The maximum temperature of primary air stream 20 and secondary air stream 28 which can be achieved in SAH 70 is limited by the temperature of extracted steam 71 exiting steam turbine 38 and the thermal resistance of SAH 70. Moreover, primary air stream 20 and secondary air stream 30 are fed by means of PA fan 72 and FD fan 74, respectively, to tri-sector APH 76, wherein these air streams are further heated by means of flue gas stream 27 before it is discharged to the atmosphere. In this manner, primary air stream 20 and secondary air stream 30 with their elevated temperatures enhance the efficiency of the operation of coal mill 18 and production of process heat in furnace 25. Furthermore, the water stream 78 discharged by condenser 50 may be recycled to boiler 32 to be converted into process steam once again. Flue gas 27 and process steam 71 exiting steam turbine 38 and the water 78 exiting the condenser which might otherwise go to waste have been successfully used to enhance the overall efficiency of the electric power generating plant 65.

As discussed above, it would further benefit the operational efficiency of the electric generating plant if the moisture level of coal 12 could be reduced prior to its delivery to furnace 25. Such a preliminary drying process could also enable the use of lower-rank coals like subbituminous and lignite coals on an economic basis.

An application entitled "Apparatus for Heat Treatment of Particulate Materials" filed on the same date as this application, which shares a common co-inventor and owner with the present application, discloses in greater detail fluidized-bed dryers and other dryer apparati that can be used in conjunction with the present invention, and are herby incorporated by reference. Nevertheless, the following details regarding the fluidized bed and segregating means are disclosed herein.

Figure 3:
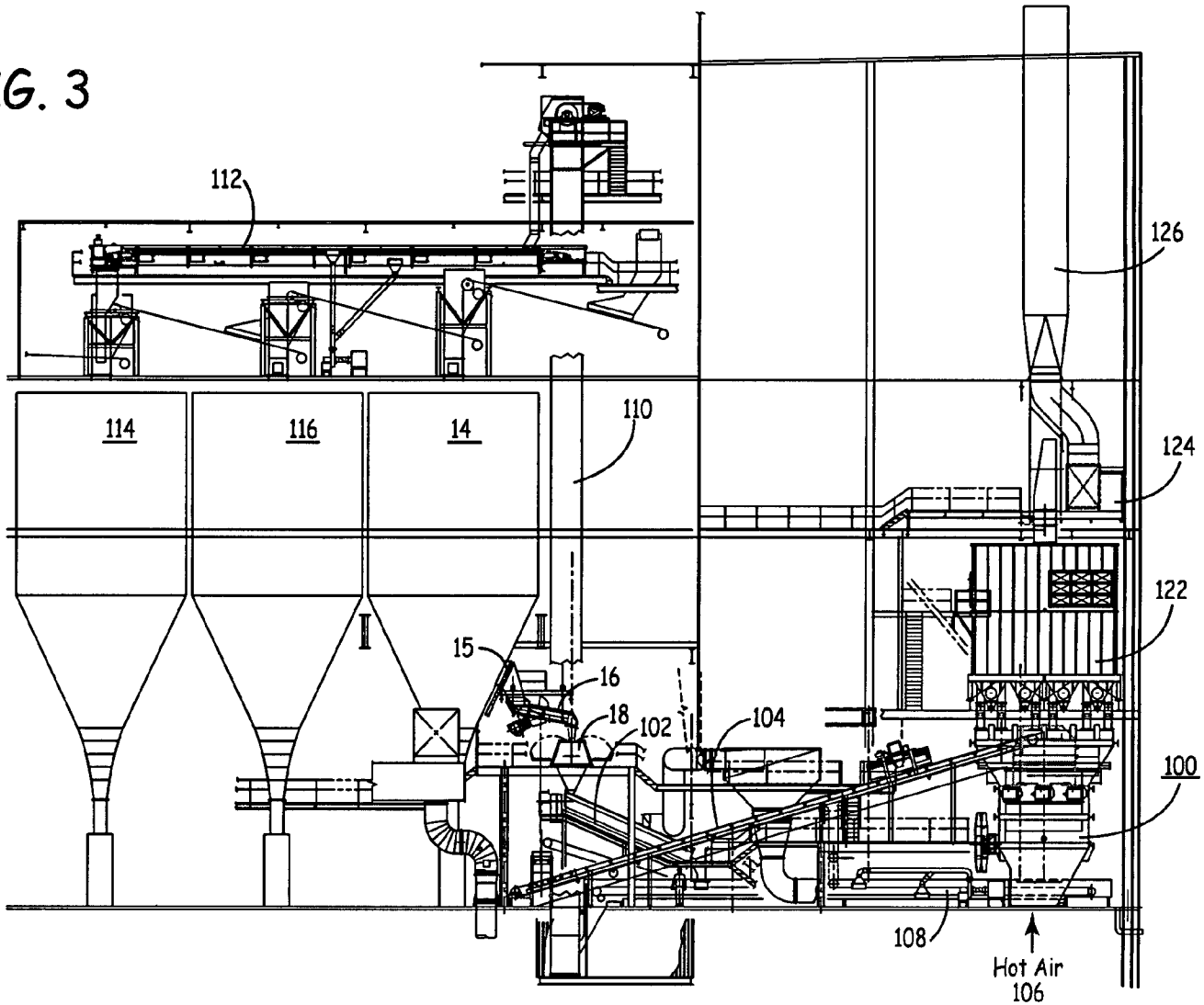
FIG. 3 is a view of a fluidized-bed dryer of the present invention and its associated equipment for conveying coal and hot fluidizing air.

FIG. 3 shows a fluidized bed dryer 100 used as the fluidized bed apparatus for purposes of separating the fluidized coal particle stream and the non-fluidized particle stream, although it should be understood that any other type of dryer may be used within the context of this invention. Moreover, the entire fluidized bed apparatus system may consist of multiple coal dryers connected in series or parallel to remove moisture from the coal. A multi-dryer approach, involving a number of identical coal drying units, provides operating and maintenance flexibility and, because of its generally smaller size requirements, allows coal dryers to be installed and integrated within existing power plant equipment, as well as in stages, one at a time. This will minimize interference with normal plant operations.

The fluidized bed(s) will operate in open air at relatively low-temperature ranges. An in-bed heat exchanger will be used in conjunction with a stationary fluidized-bed or fixed-bed design to provide additional heat for coal drying and, thus, reduce the necessary equipment size. With a sufficient in-bed heat transfer surface in a fluidized bed dryer, the fluidizing/drying air stream can be reduced to values corresponding to the minimum fluidization velocity. This will reduce erosion damage to and elutriation rate for the dryer.

Heat for the in-bed heat exchanger can be supplied either directly or indirectly. A direct heat supply involves diverting a portion of hot fluidizing air stream, hot condenser cooling water, process steam, hot flue gas, or other waste heat sources and passing it through the in-bed heat exchanger. An indirect heat supply involves use of water or other heat transfer liquid, which is heated by hot primary air stream, hot condenser cooling water, steam extracted from steam turbine cycle, hot flue gas, or other waste heat sources in an external heat exchanger before it is passed through the in-bed heat exchanger.

The bed volume can be unitary or divided into several sections, referred to herein as "stages." A fluidized-bed dryer is a good choice for treating sized coal to be burned at the same site where the coal is to be combusted. The multiple stages could be contained in a single vessel or multiple vessels. A multi-stage design allows maximum utilization of fluidized-bed mixing, segregation, and drying characteristics. The coal dryer may include a direct or indirect heat source for drying the coal.

FIG. 3 discloses a coal dryer in the form of a fluidized-bed dryer 100 and associated equipment at an industrial plant site. Wet coal 12 is stored in bunker 14 whereupon it is released by means of feed gate 15 to vibrating feeder 16 which transports it to coal mill 18 to pulverize the coal particles. The pulverized coal particles are then passed through screen 102 to properly size the particles to less than ¼ inch in diameter. The sized pulverized coal particles are then transported by means of conveyor 104 to the upper region of the fluidized-bed dryer 100 in which the coals particles are fluidized and dried by means of hot air 160. The dried coal particles are then conveyed by lower dry coal conveyor 108, bucket elevator 110, and upper dry coal conveyor 112 to the top of dried coal bunkers 114 and 116 in which the dried coal particles are stored until needed by the boiler furnace 25.

Moist air and elutriated fines 120 within the fluidized-bed dryer 100 are transported to the dust collector 122 (also known as a "baghouse") in which elutriated fires are separated from the moist air. Dust collector 122 provides the force for pulling the moist air and elutriated fires into the dust collector. Finally, the air cleaned of the elutriated fires is passed through stack 126 for subsequent treatment within a scrubber unit (not shown) of other contaminants like sulfur, $NO_x$, and mercury contained within the air stream.

Figure 4:
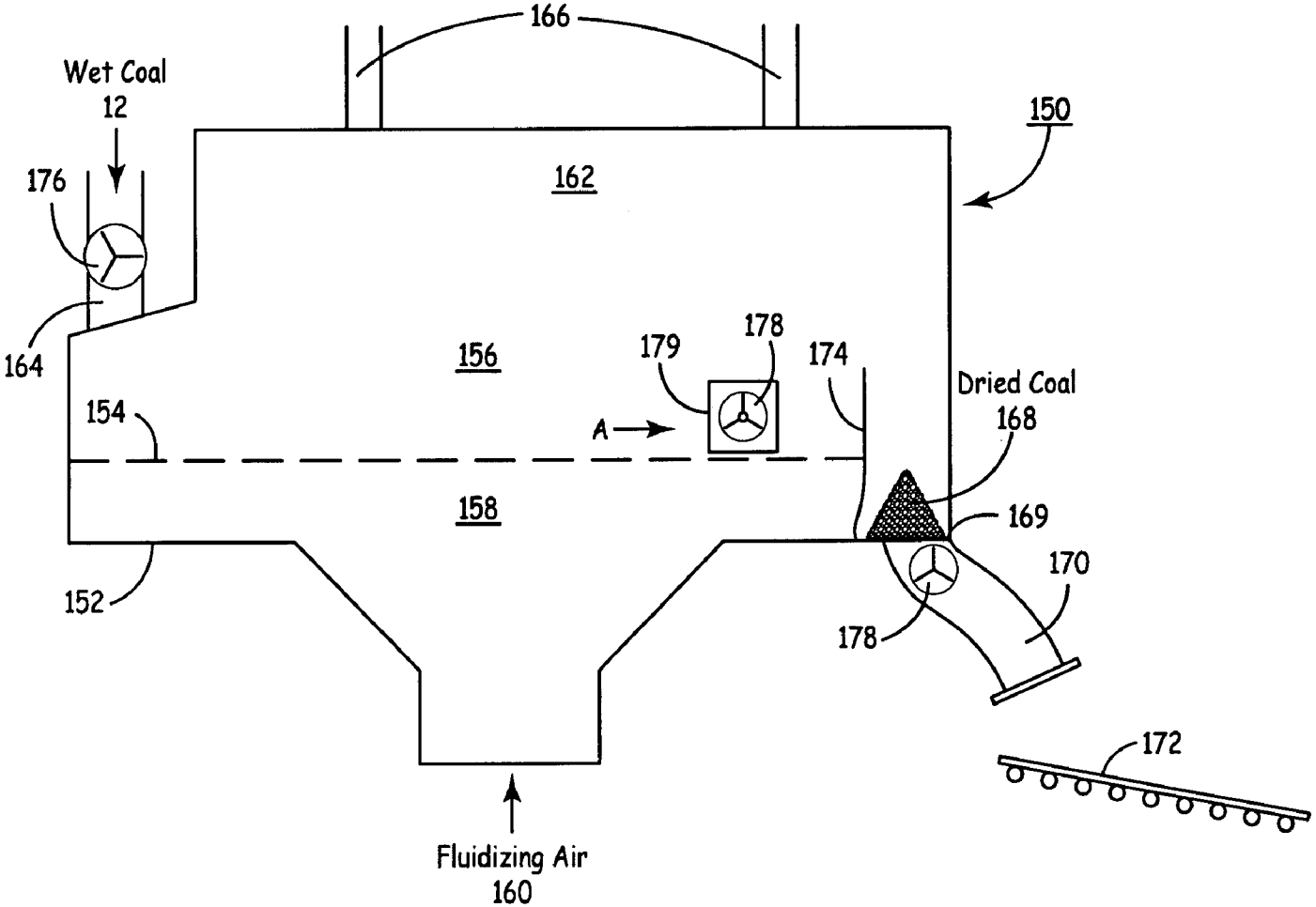
FIG. 4 is a schematic-diagram of a single-stage fluidized-bed dryer of the present invention.
Figure 5:
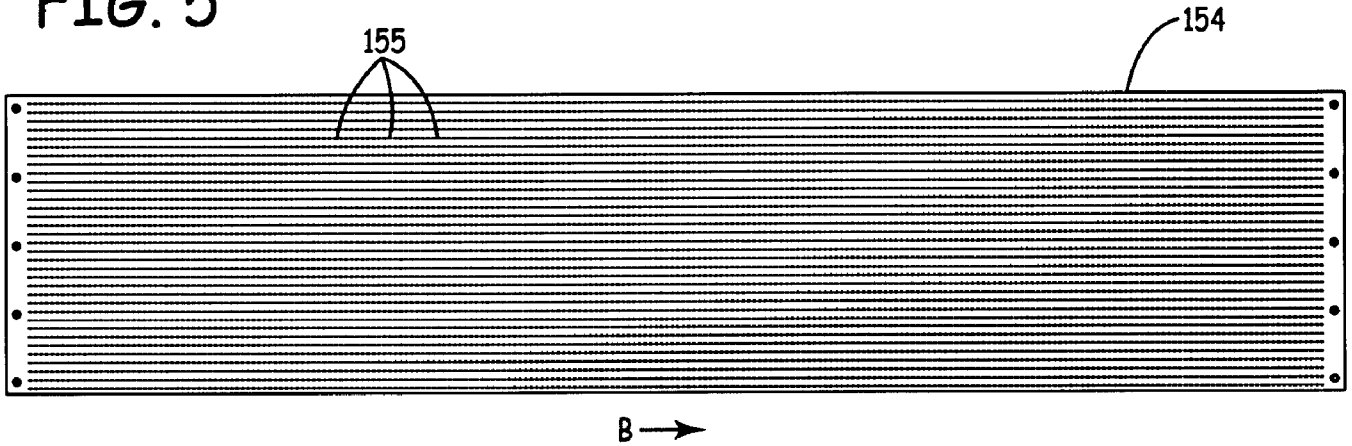
FIG. 5 is a plan view of a distributor plate for the fluidized-bed dryer of the present invention.

FIG. 4 discloses an embodiment of a coal drying bed under the present invention that is a single-stage, single-vessel, fluidized-bed dryer 150 with a direct heat supply. While there are many different possible arrangements for the fluidized-bed dryer 150, common functional elements include a vessel 152 for supporting coal for fluidization and transport. The vessel 152 may be a trough, closed container, or other suitable arrangement. The vessel 152 includes a distributor plate 154 that forms a floor towards the bottom of vessel 152, and divides the vessel 154 into a fluidized bed region 156 and a plenum region 158. As shown in FIG. 5, the distributor plate 154 may be perforated or constructed with suitable value means to permit fluidizing air 160 to enter the plenum region 158 of vessel 152. The fluidizing air 160 is distributed throughout the plenum region 158 and forced upwards through the openings 155 or valves in the distributor plate 154 at high pressure to fluidize the coal 12 lying within the fluidized bed region 156.

An upper portion of vessel 152 defines a freeboard region 162. Wet sized coal 12 enters the fluidized bed region 156 of fluidized bed dryer 150 through entry point 164 as shown in FIG. 4. When the wet sized coal 12 is fluidized by fluidizing air 160, the coal moisture and elutriated coal fines are propelled through the freeboard region 162 of vessel 152 and exit the vessel typically at the top of the fluidized-bed dryer 150 at vent outlet points 166, as shown. Meanwhile, fluidized coal product 168 will exit the vessel 152 via discharge chute 170 to a conveyor 172 for transport to a storage bin or furnace boiler. As the fluidized coal particles move across the fluidized bed region 156 above the distributor plate 154 in the direction A shown in FIG. 4, they will build up against weir 174 which constitutes a wall traversing the width of the fluidized-bed dryer. The height of the weir 174 will define the maximum thickness of the fluidized-bed of coal particles within the dryer, for as the accumulated coal particles rise above the height of the weir, they will necessarily pass over the top of the weir and fall into a region of the fluidized-bed dryer 150 adjacent to the discharge chute 170. Meanwhile, the larger and denser coal particles ("undercut") will naturally gravitate towards the bottom of the fluidized bed 156 due to their higher specific gravity. A conveyor means 178 described more fully herein will push or otherwise transfer these non-fluidized undercut coal particles through a discharge outlet 179, so they exit the fluidized bed. The structure and location of the coal inlet 164 and outlet points 169 and 179, the elutriated fines outlet 166, the distributor plate 154, and configuration of the vessel 152 may be modified as desired for best results.

Fluidized-bed dryer 150 preferably includes a wet bed rotary airlock 176 operationally connected to wet coal inlet 164 maintaining a pressure seal between the coal feed and the dryer, while permitting introduction of the wet coal feed 12 to the fluidized bed 156. Rotary airlock 176 should have a housing of cast iron construction with a nickel-carbide coated bore. The end plates of the airlock should be of cast iron construction with a nickel-carbide coated face. Airlock rotors should be of cast iron construction with closed end, leveled tips, and satellite welded. In an embodiment of the invention, airlock 176 should be sized to handle approximately 115 tons/hour of wet coal feed, and should rotate at approximately 13 RPM at 60% fill to meet this sizing criterion. The airlock is supplied with a 3 hp inverter duty gear motor and an air purge kit. While airlock 176 is direct connected to the motor, any additional airlocks provided at additional wet coal inlets to the fluidized-bed dryer can be chain driven. Note that an appropriate coating material like nickel carbide is used on cast iron surfaces of the airlock that are likely to suffer over time from passage of the abrasive coal particles. This coating material also provides a "non-stick surface" to the airlock parts that come into contact with the coal particles.

A product rotary airlock 178 is supplied air in operative connection to the fluidized-bed dryer outlet point 169 to handle the dried coal product 168 as it exits the dryer. In an embodiment of the invention, airlock 178 should have a housing of cast iron construction with a nickel-carbide coated bore. Airlock end plates should likewise be of cast iron construction with a nickel-carbide coated face. The airlock rotor should be of cast iron construction with a closed end, leveled tips, and satellite welded. The airlock should preferably rotate at approximately 19 RPM at 60% fill to meet the sizing criterion. The airlock should be supplied with a 2 hp inverter duty generator, chain drive, and air purge kit.

Distributor plate 154 separates the hot air inlet plenum 158 from the fluidized-bed drying chambers 156 and 162. The distributor plate should preferably be fabricated from ⅜-inch thick water jet drilled 50,000 psi-yield carbon steel as shown in FIG. 5. The distributor plate 154 may be flat and be positioned in a horizontal plane with respect to the fluidized-bed dryer 150. The openings 155 should be approximately ⅛-inch in diameter and be drilled on approximately 1-inch centers from feed end to discharge end of the distributor plate, 12-inch center across, and in a perpendicular orientation with respect to the distributor plate. More preferably, the openings 155 may be drilled in approximately a 65°-directional orientation with respect to the distributor plate so that the fluidizing air 160 forced through the opening 155 in the distributor plate blows the fluidized coal particles within the fluidized-bed region 156 towards the center of the dryer unit and away from the side walls. The fluidized coal particles travel in direction B shown in FIG. 5. Such a flat, planar distributor plate 154 would work well where the conveyor means 178 is a belt, ram, drag chain, or other similar device located in the fluidized bed above the distributor plate.

Figure 6:
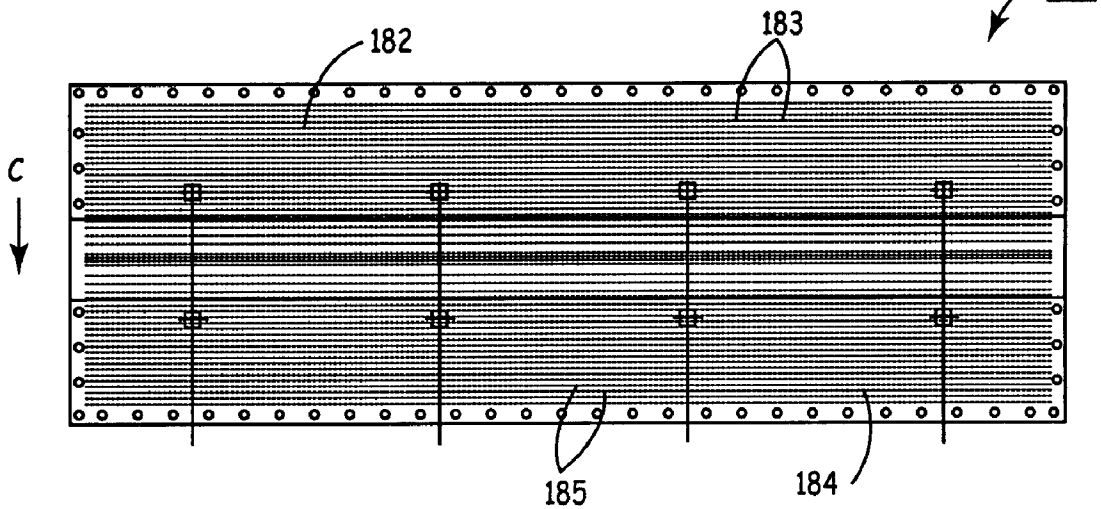
FIG. 6 is a plan view of another embodiment of the distributor plate for the fluidized-bed dryer.
Figure 7:
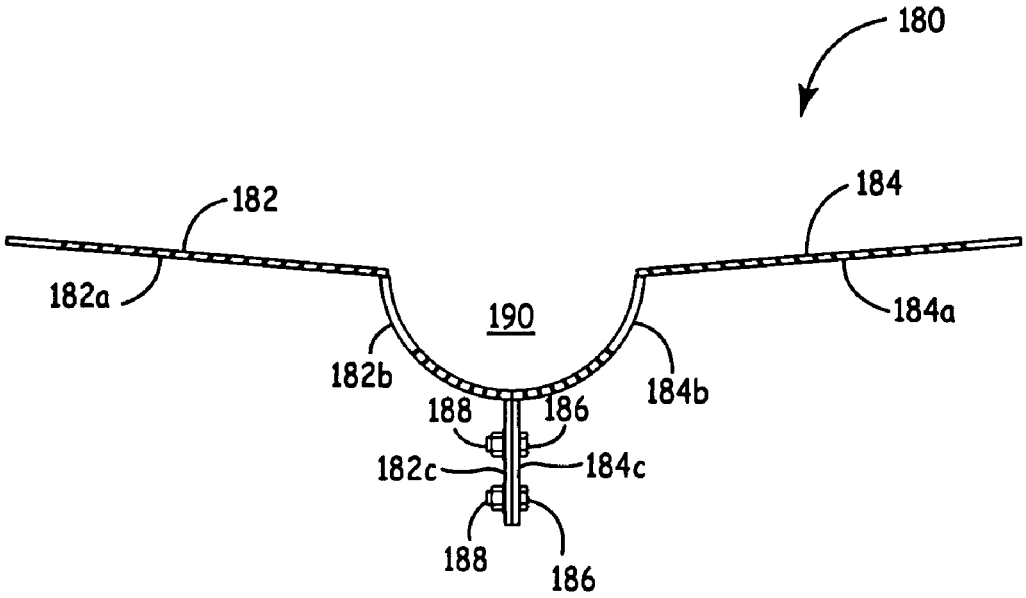
FIG. 7 is a view of the distributor plate taken along line 7-7 of FIG. 6.

Another embodiment of the distributor plate 180 is shown in FIGS. 6-7. Instead of a flat planar plate, this distributor plate 180 consists of two drilled plates 182 and 184 that have flat portions 182*a* and 184*b*, rounded portions 182*b* and 184*b*, and vertical portions 182*c* and 184*c*, respectively. The two vertical portions 182*c* and 184*c* are bolted together by means of bolts 186 and nuts 188 in order to form the distributor plate unit 180. "Flat" portions 182*a* and 184*a* of the distributor plate 180 are actually installed on a 5° slope towards the middle of the dryer unit in order to encourage the coal particles to flow towards the center of the distributor plate. Meanwhile, rounded portions 182*b* and 184*b* of the distributor plate units cooperate to define a half-circle region 190 approximately one foot in diameter for accommodating a screw auger 192, as shown more clearly in FIG. 8. The drilled openings 183 and 185 in the distributor plate units 182 and 184, respectively, will once again be on an approximately 1-inch centers from the feed end to the discharge end and ½-inch center across, having a 65°-directional slope with respect to the horizontal plane of the dryer unit). While the flat portions 182*a* and 184*a* and vertical portions 182*a* and 184*c* of the distributor plate units 182 and 184 should be made from ⅜-inch thick water jet drilled 50,000 psi-yield carbon steel, the rounded portions 182*b* and 184*b* will preferably be formed from ½-inch thick carbon steel for increased strength around the screw trough 190. Fluidized coal particles travel in direction C shown in FIG. 6.

Figure 8:
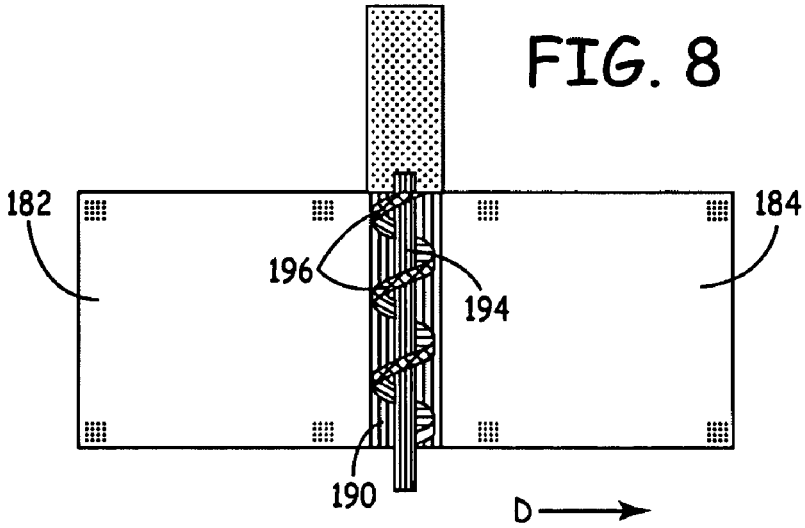
FIG. 8 is a plan view of the distributor plate of FIG. 6 containing a screw auger.

A screw auger 194 is positioned within the trough region 190 of the distributor plate, as shown on FIG. 8. This screw auger should have a 12-inch diameter, be sized for 11.5 tons/hour removal of the oversized coal particles in the dryer bed, and have sufficient torque to start under a 4-foot thick deep bed of coal particles. The drive will be a 3-hp inverter duty motor with a 10:1 turndown. The screw auger 194 should be of carbon steel construction for durability.

The trough 190 of the distributor plate 180 and screw auger 194 should be perpendicular to the longitudinal direction of the dryer. This enables the fins 196 of the screw auger during operation to engage the undercut coal particles along the bottom of the fluidized coal bed and push them out the discharge outlet 179 of the fluidized bed dryer.

Figure 9:
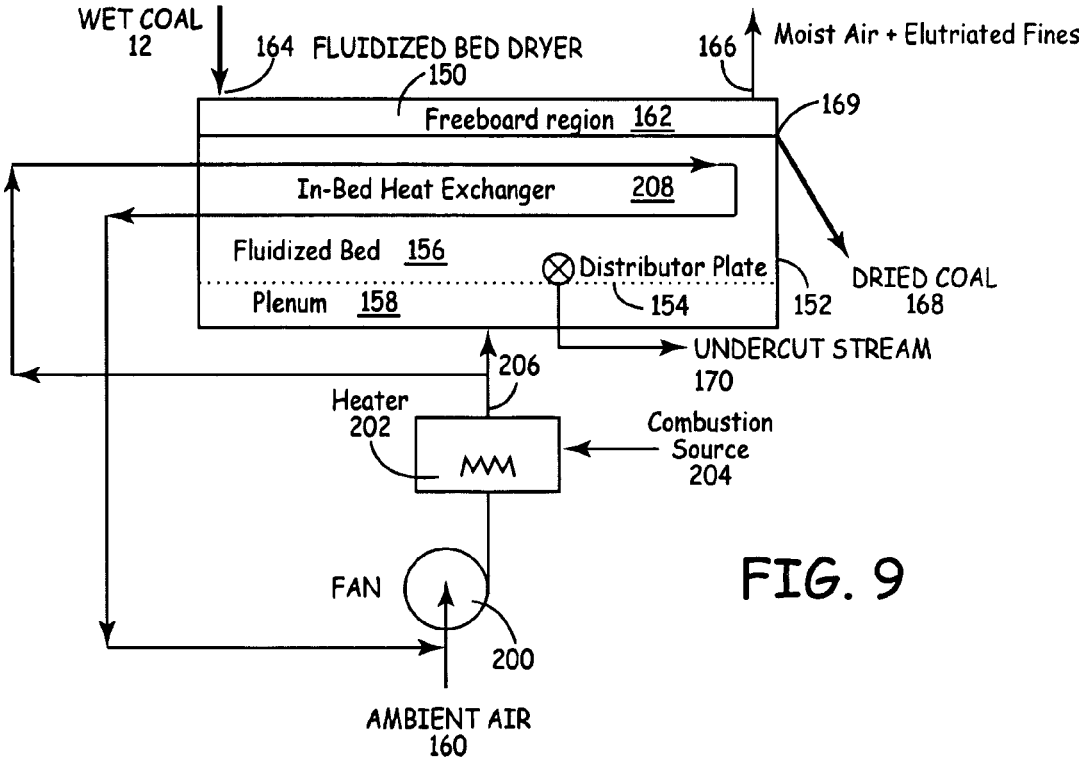
FIG. 9 is a schematic diagram of a single-stage fluidized-bed dryer of the present invention that utilizes a primary heat source to heat indirectly the fluidizing air used both the dry and fluidize the coal.

FIG. 9 discloses the fluidized bed dryer 150 of FIG. 4 in schematic form wherein the same numbers have been used for the corresponding dryer parts for ease of understanding. Ambient air 160 is drawn by means of a fan 200 through a heater 202 heated by a combustion source 204. A portion of the fluidizing air 206, heated by circulation through heater 202, is directed to the fluidized bed region 156 for fluidizing the wet sized coal 12. Any suitable combustion source like coal, oil, or natural gas may be used for heater 202.

While such heated fluidizing air 206 can be used to heat the coal particles 12 that are fluidized within the bed region 156 and evaporate water on the surface of the particles by connective heat transfer with the heated fluidizing air, an inbed heat exchanger 208 is preferably included within the dryer bed to provide heat conduction to the coal particles to further enhance this heating and drying process. A direct heat supply is created by diverting the remainder of the fluidizing hot air 206 (heated by heater 202) through in-bed heat exchanger 208, which extends throughout the fluidized bed 156, to heat the fluidized coal to drive out moisture. The fluidizing air 206 exiting the in-bed heat exchanger 208 is recycled back to fan 200 to once again be circulated through and heated by the heater 202. Some loss of fluidizing air 206 results when fluidizing air directly enters the fluidized bed region 156 through plenum 158. This lost air is replaced by drawing further ambient air 160 into the circulation cycle.

Figure 10:
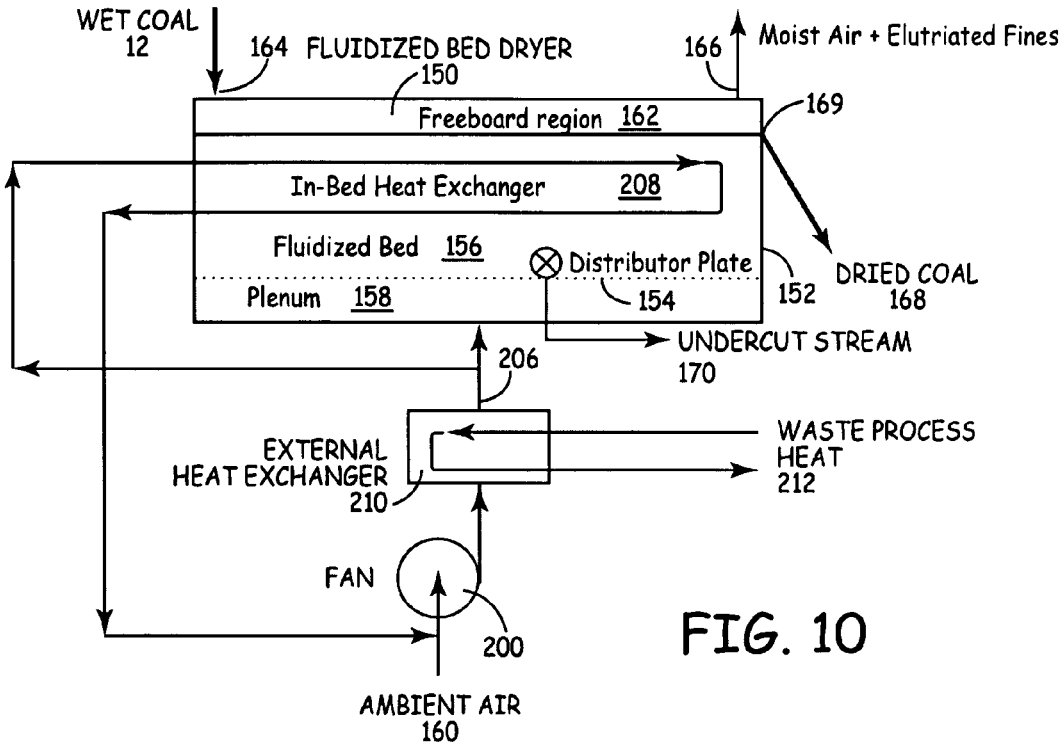
FIG. 10 is a schematic diagram of a single-stage fluidized bed dryer of the present invention that utilizes waste process heat to indirectly heat the fluidizing air used both to dry and fluidize the coal.

FIG. 10 illustrates another embodiment of the single-stage, single-vessel, fluidized bed dryer 150 of FIG. 4 except that an external heat exchanger 210 is substituted for heater 202, and waste process heat 212 from the surrounding industrial process plant is used to heat this external heat exchanger. Because industrial process plants like electricity generation plants typically have available waste process heat sources that would otherwise be discarded, this configuration of the present invention enables the productive use of this waste process heat to heat and dry the wet coal 12 in the fluidized bed dryer 150 in order to enhance the boiler efficiencies from the combustion of such dried coal on a more commercially viable basis. The use of a primary heat source like coal, oil, or natural gas, as shown in FIG. 9, is a more expensive option for drying the coal particles.

Figure 11:
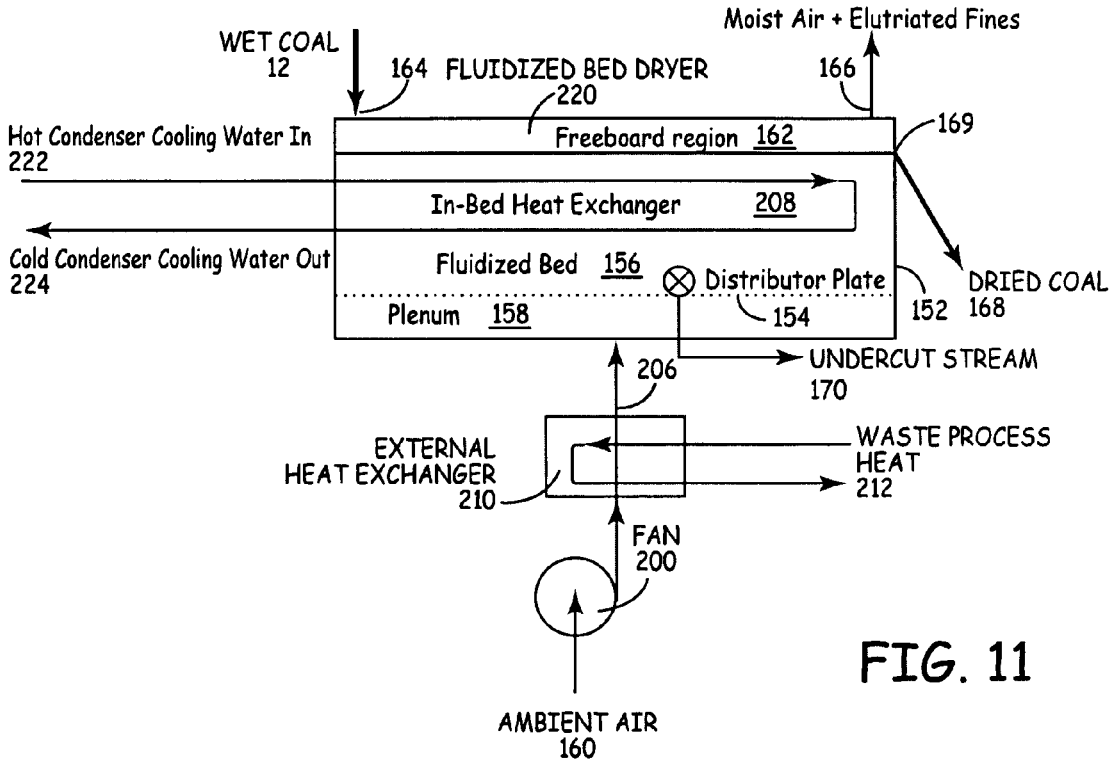
FIG. 11 is a schematic diagram of a single-stage fluidized bed dryer of the present invention that utilizes a combination of waste process heat to heat the fluidizing air used to fluidize the coal (indirect heat), and hot condenser cooling water circulated through an in-bed heat exchanger contained inside the fluidized bed dryer to dry the coal (direct heat).

FIG. 11 illustrates yet another embodiment of a single-stage, single-vessel, fluidized bed dryer 220 that is similar to the one shown in FIG. 10, except that the waste process heat 212 is not used to heat both the external heat exchanger 210 and the in-bed heat exchanger 208. Instead, a portion of the hot condenser cooling water 222 from elsewhere in the electricity generation plant operation is diverted to in-bed heat exchanger 208 to provide the necessary heat source. Thus, in the fluidized dryer embodiment 220 of FIG. 11, two separate waste heat sources (i.e., waste process heat and hot condenser cooling water) are employed to enhance the operational efficiency of the coal drying process.

Figure 12:
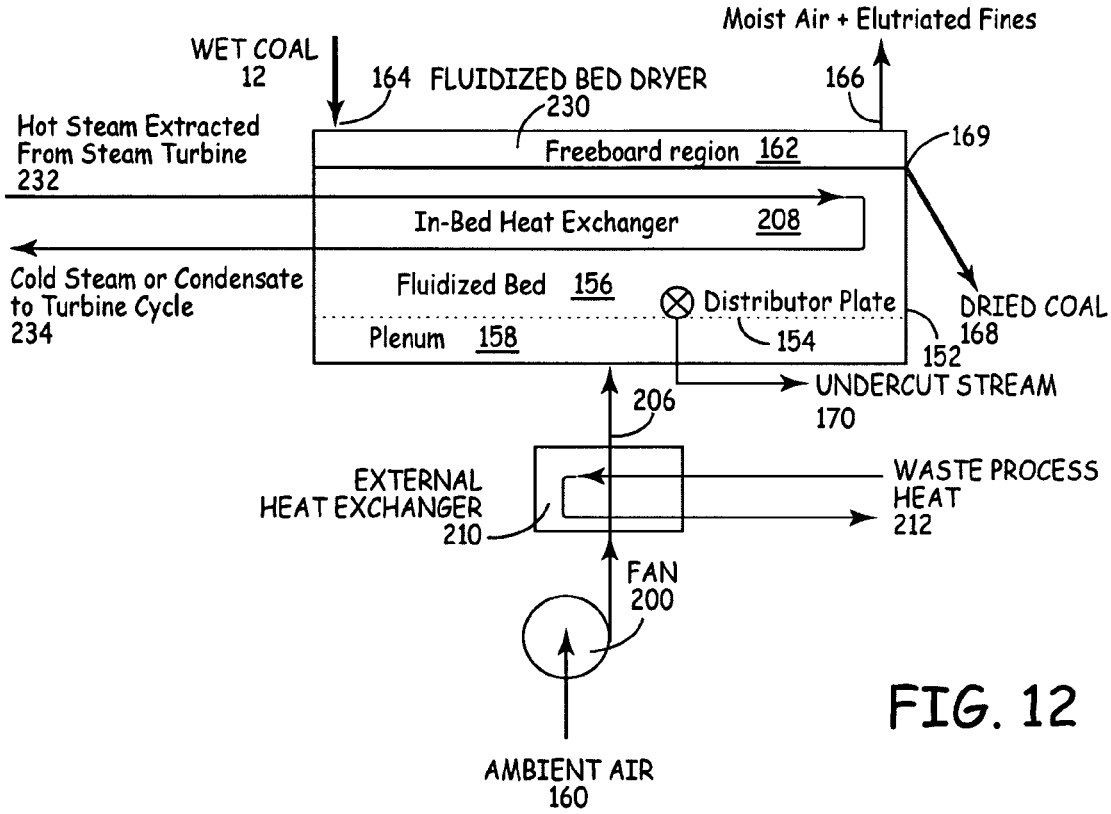
FIG. 12 is a schematic diagram of a single-stage fluidized bed dryer of the present invention that utilizes a combination of waste process heat to heat the fluidizing air used to fluidize the coal (indirect heat), and hot steam extracted from a steam turbine cycle and circulated through an in-bed heat exchanger contained inside the fluidized bed dryer to dry the coal (direct heat).

FIG. 12 shows still another embodiment of a single-stage, single-vessel, fluidized bed dryer 230 similar to the one depicted in FIG. 11, except that hot process steam 232 extracted from the steam turbines of the electricity power plant is used instead of hot condenser cooling water as a heat source for in-bed heat exchanger 208. Again, fluidized bed dryer 230 uses two different waste heat sources (i.e., waste process heat 212 and hot process steam 232) in order to enhance the operating efficiency of the coal drying process.

Figure 13:
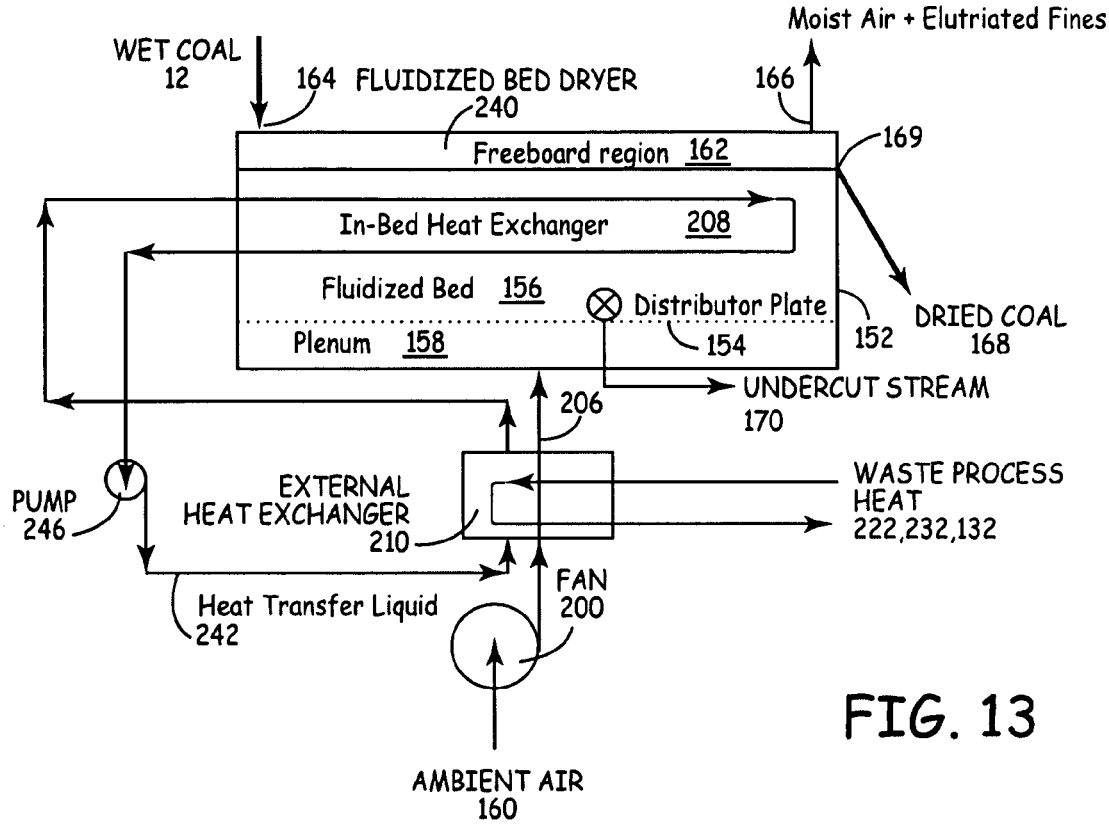
FIG. 13 is a schematic diagram of a single-stage fluidized bed dryer of the present invention that utilizes waste process heat to both heat the fluidizing air used to fluidize the coal (indirect heat), and to heat the transfer liquid circulated through an in-bed heat exchanger contained inside the fluidized bed dryer to dry the coal (indirect heat).
Figure 14:
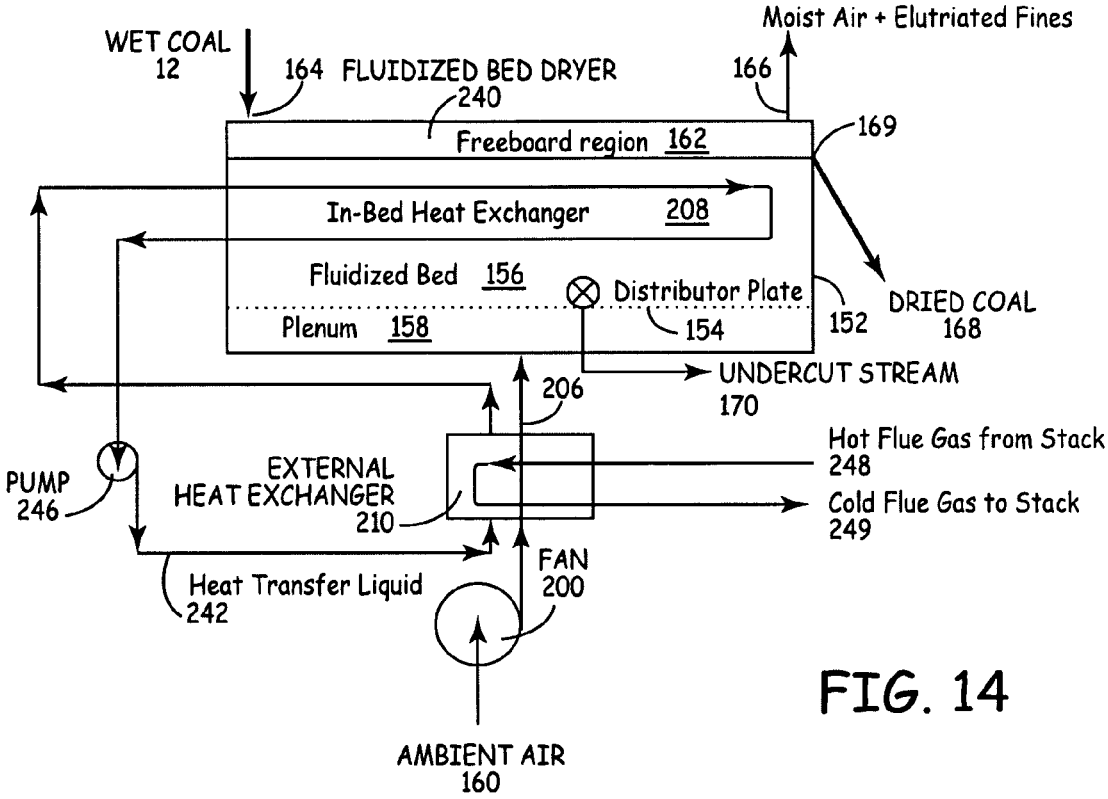
FIG. 14 is a schematic diagram of a single-stage fluidized bed dryer of the present invention that utilizes hot flue gas from a plant furnace stack to both heat the fluidizing air used to fluidize the coal (indirect heat), and to heat the transfer liquid circulated through an in-bed heat exchanger contained inside the fluidized bed dryer to dry the coal (indirect heat).

Another embodiment of a fluidized bed dryer is shown in FIGS. 13-14, entailing a single-stage, single-vessel, fluidized bed dryer 240 with an indirect heat supply. An indirect heat supply to the in-bed heat exchanger 208 is provided by the use of water or other heat transfer liquid 242, which is heated by the fluidizing air 206, hot condenser cooling water 222, process steam 232 extracted from the steam turbine cycle, or hot flue gas 248 from the furnace stack in an external heat exchanger 210, and then circulated through the in-bed heat exchanger 208 by means of pump 246, as illustrated in FIG. 13. Any combination of these sources of heat (and other sources) may also be utilized.

Figure 15:
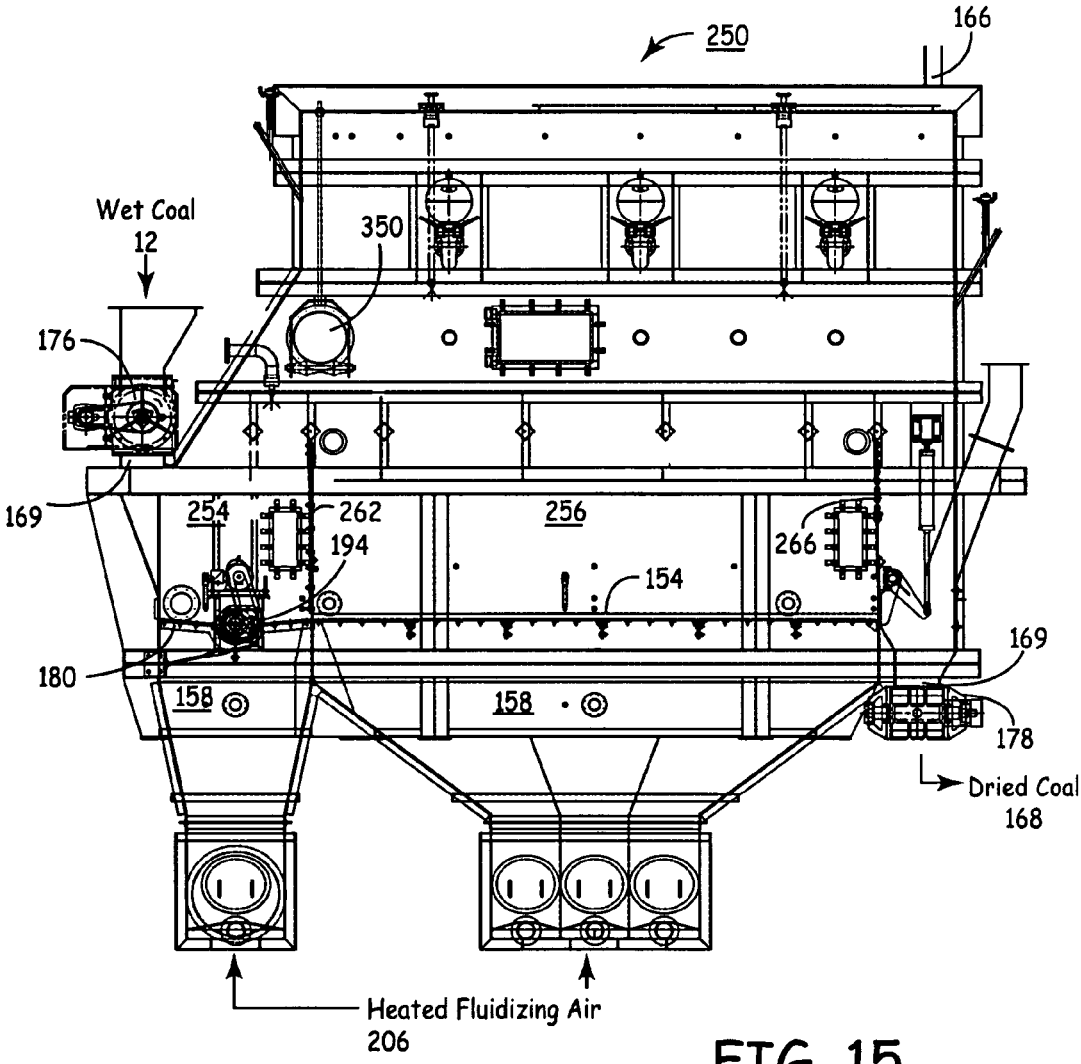
FIG. 15 is a view of a two-stage fluidized-bed dryer of the present invention.
Figure 16:
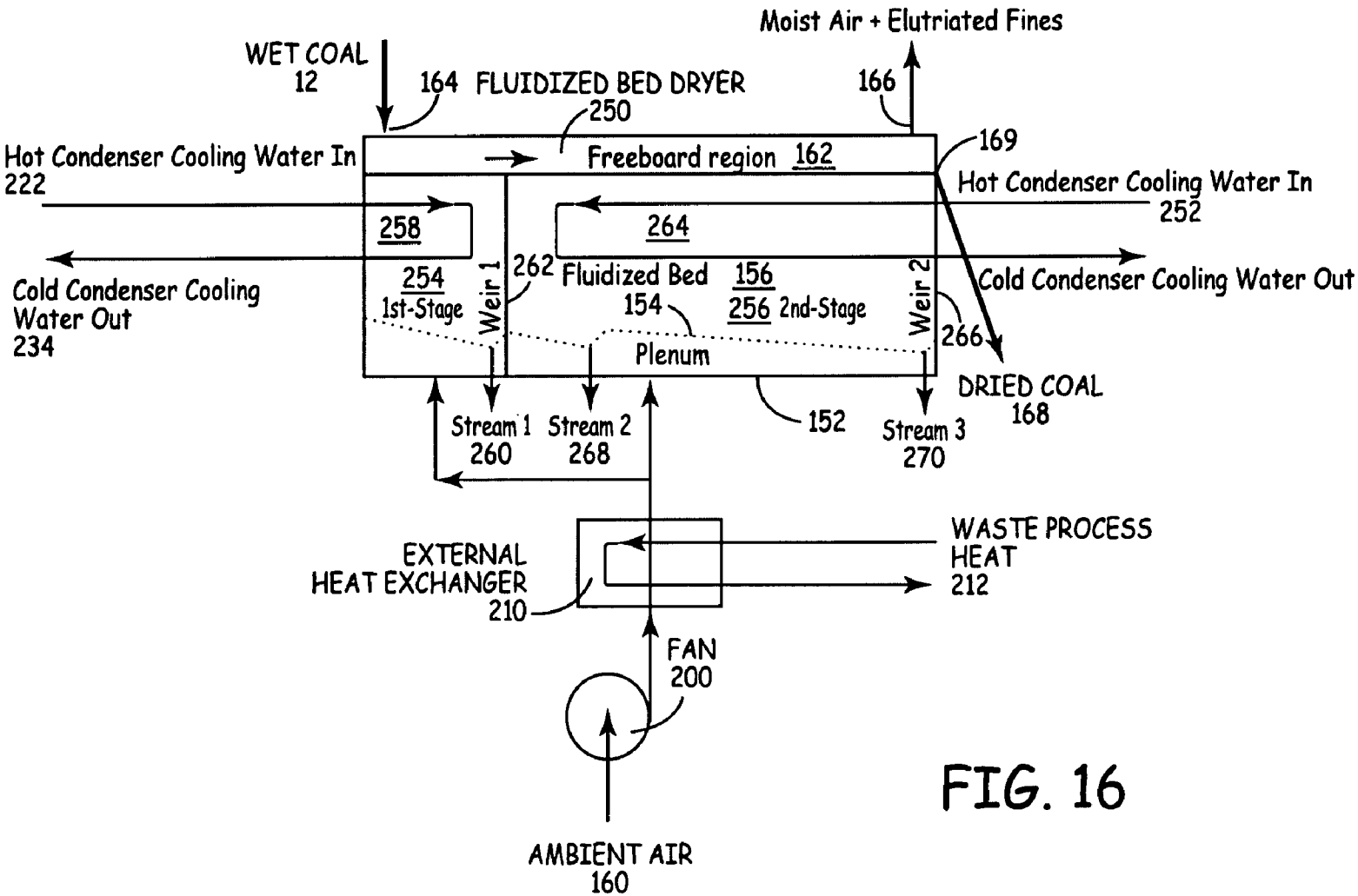
FIG. 16 is a schematic diagram of a two-stage fluidized bed dryer of the present invention that utilizes waste process heat from the plant operations to heat the fluidizing air used to fluidize the coal in both chambers of the fluidized bed dryer (indirect), and hot condenser cooling water circulated through in-bed heat exchangers contained inside both chambers of the fluidized bed dryer to dry the coal (direct heat).

Still another embodiment of an open-air, low-temperature fluidized bed dryer design of the present invention is illustrated in FIGS. 15-16, which is a multiple-stage, single-vessel, fluidized bed dryer 250 with a direct heat supply (hot condenser cooling water 252 from the cooling tower of electric power plant) to an in-bed heat exchanger 208. Vessel 152 is divided in two stages: a first stage 254 and second stage 256. Although illustrated in FIGS. 15-16 as a two-stage dryer, additional stages may be added and further processing can be achieved. Typically, wet sized coal 12 enters the first stage 254 of the fluidized bed drier 250 through the freeboard region 162 at entry point 164. The wet sized coal 12 is preheated and partially dried (i.e., a portion of surface moisture is removed) by hot condenser cooling water 252 entering, circulating and exiting through the heating coils of in-bed heat exchanger 258 contained inside the first stage 254 (direct heat). The wet sized coal 12 is also heated and fluidized by hot fluidizing air 206. Fluidizing air 206 is forced by fan 200 through the distributor plate 154 of the first stage 254 of the fluidized bed dryer 250 after being heated by waste process heat 212 in external heat exchanger 210.

In the first stage 254, the hot fluidization air stream 206 is forced through the wet sized coal 12 supported by and above distributor plate 154 to dry the coal and separate the fluidizable particles and non-fluidizable particles contained within the coal. Heavier or denser, non-fluidizable particles segregate out within the bed and collect at its bottom on the distributor plate 154. These non-fluidizable particles ("undercut") are then discharged from the first stage 254 as Stream 1 (260). Fluidized bed dryers are generally designed to handle non-fluidized material up to four inches thick collecting at the bottom of the fluidized bed. The non-fluidized material may account for up to 25% of the coal input stream. This undercut stream 260 can be directed through another beneficiation process or simply be rejected. Movement of the segregated material along the distributor plate 154 to the discharge point for stream 260 is accomplished by an inclined horizontal-directional distributor plate 154, as shown in FIG. 16. The first stage 254 therefore separates the fluidizable and non-fluidizable material, pre-dries and preheats the wet sized coal 12, and provides uniform flow of the wet sized coal 12 to the second stage 256 contained within the fluidized bed dryer 250. From the first stage 254, the fluidized coal 12 flows airborne over a first weir 262 to the second stage 256 of the bed dryer 250. In this second stage of the bed dryer 250, the fluidized coal 12 is further heated and dried to a desired outlet moisture level by direct heat, hot condenser cooling water 252 entering, circulating, and exiting the heating coils of the in-bed heat exchanger 264 contained within the second stage 256 to radiate sensible heat therein. The coal 12 is also heated, dried, and fluidized by hot fluidizing air 206 forced by fan 200 through the distributor plate 154 into the second stage 256 of the fluidized bed dryer 250 after being heated by waste process heat 212 in external heat exchanger 210.

The dried coal stream is discharged airborne over a second weir 266 at the discharge end 169 of the fluidized bed dryer 250, and elutriated fines 166 and moist air are discharged through the top of the dryer unit. This second stage 256 can also be used to further separate fly ash and other impurities from the coal 12. Segregated material will be removed from the second stage 256 via multiple extraction points 268 and 270 located at the bottom of the bed 250 (or wherever else that is appropriate), as shown in FIG. 16 as Streams 2 (268) and 3 (270). The required number of extraction points may be modified depending upon the size and other properties of the wet sized coal 12, including without limitation, nature of the undesirable impurities, fluidization parameters, and bed design. The movement of the segregated material to the discharge point(s) 260, 268, and 270 can be accomplished by an inclined distributor plate 154 shown in FIG. 16, or by existing commercially available horizontal-directional distributor plates. Streams 1, 2 and 3 may be either removed from the process and land-filled or further processed to remove undesirable impurities.

The fluidization air stream 206 is cooled and humidified as it flows through the coal bed 250 and wet sized coal 12 contained in both the first stage 254 and second stage 256 of the fluidized bed 156. The quantity of moisture which can be removed from the coal 12 inside the dryer bed is limited by the drying capacity of the fluidization air stream 206. Therefore, the heat inputted to the fluidized bed 156 by means of the heating coils of the in-bed heat exchangers 258 and 264 increases the drying capacity of fluidizing air stream 206, and reduces the quantity of drying air required to accomplish a desired degree of coal drying. With a sufficient in-bed heat transfer surface, drying air stream 206 could be reduced to values corresponding to the minimum fluidization velocity needed to keep particulate suspended. This is typically in the 0.8 meters/second range, but the rate could be increased to run at a higher value, such as 1.4 meters/second, to assure that the process never drops below the minimum required velocity.

To achieve maximum drying efficiency, drying air stream 206 leaves fluidized bed 156 at saturation condition (i.e., with 100% relative humidity). To prevent condensation of moisture in the freeboard region 162 of the fluidized bed dryer 250 and further downstream, coal dryer 250 is designed for outlet relative humidity less than 100%. Also, a portion of the hot fluidizing air 206 may be bypassed around the fluidized bed 156, and mixed with the saturated air in the freeboard region 162 to lower its relative humidity (e.g., sparging), as explained more fully herein. Alternatively, reheat surfaces may be added inside the freeboard region 162 of the fluidized bed dryer 250 or heating of vessel skin, or other techniques may be utilized to increase the temperature and lower the relative humidity of fluidization air 206 leaving the bed dryer 250, and prevent downstream condensation. The moisture removed in the dryer is directly proportional to the heat input contained in the fluidizing air and heat radiated by the in-bed heat exchangers. Higher heat inputs result in higher bed and exit temperatures, which increase the Water transport capabilities of the air, thereby lowering the required air-to-coal ratio required to achieve the desired degree of drying. The power requirements for drying are dependent upon the air flow and the fan differential pressure. The ability to add heat in the dryer bed is dependant upon the temperature differential between the bed and heating water, the heat transfer coefficient, and the surface area of the heat exchanger. In order to use lower temperature waste heat, more heat transfer area is therefore needed to introduce the heat into the process. This typically means a deeper bed to provide the necessary volume for the heat coils of the in-bed heat exchangers. Thus, intended goals may dictate the precise dimensions and design configuration of the fluidized bed dryer of the present invention.

Coal streams going into and out of the dryer include the wet sized coal 12, processed coal stream, elutriated fines stream 166, and the undercut streams 260, 268, and 270. To deal with the non-fluidizable coal, the dryer 250 is equipped with a screw auger 194 contained within the trough region 190 of first-stage distributor plate 180 in association with a collection hopper and scrubber unit for collecting the undercut coal particles, as disclosed more fully herein.

Typical associated components of a dryer include, amongst others, coal delivery equipment, coal storage bunker, fluidized bed dryer, air delivery and heating system, in-bed heat exchanger(s), environmental controls (dust collector), instrumentation, and a control and data acquisition system. In one embodiment, screw augers are used for feeding moist coal into and extracting the dried coal product out of the dryer. Vane feeders can be used to control the feed rates and provide an air lock on the coal streams into and out of the dryer. Load cells on the coal bunker provide the flow rate and total coal input into the dryer. Instrumentation could include, without limitation, thermocouples, pressure gauges, air humidity meters, flow meters and strain gauges.

With respect to fluidized-bed dryers, the first stage accomplishes pre-heating and separation of non-fluidizable material. This can be designed as a high-velocity, small chamber to separate the coal. In the second stage, coal dries by evaporation of coal moisture due to the difference in the partial pressures between the water vapor and coal. In a preferred embodiment, most of the moisture is removed in the second stage.

Figure 17:
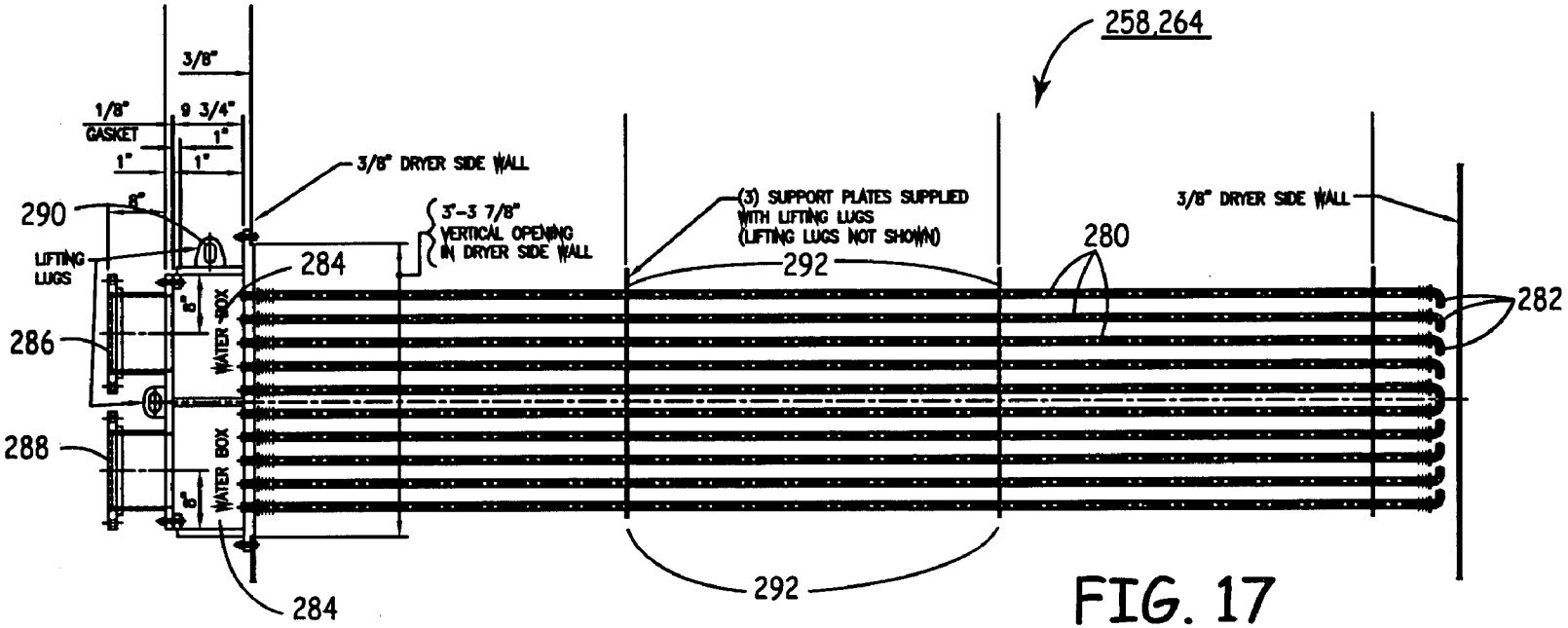
FIG. 17. is a side view of the heating coils employed within the dryer bed.
Figure 18:
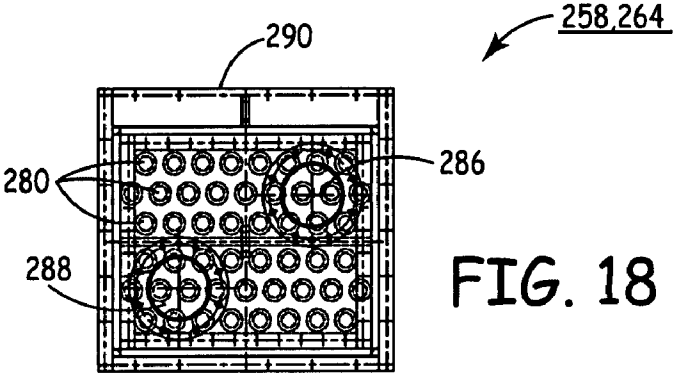
FIG. 18 is a view of the heating coils taken along line 18-18 of FIG. 17.

The heating coils 280 contained within the in-bed heat exchanges 258 and 264 of fluidized-bed dryer 250 are shown more clearly in FIGS. 17-18. Each heating coil is of carbon steel construction consisting of a two-pass, U-tube coil connection 282 with an integral water box 284 connected thereto with a cover, inlet flange 286, outlet flange 288, and lifting lugs 290. These heating coil bundles are designed for 150 psig at 300° F. with 150# ANSI flanges for the water inlet 286 and outlet 288. The heating coil tubes 280 are oriented across the width of the first-stage 254 and second-stage 256 of the dryer unit, and support plates 292 with lifting lugs are interspaced along the length of the heating coil bundles to provide lateral support.

An embodiment of the first-stage heat exchanger 258 contains 50 heating coil pipes (280) having a 1½-inch diameter with Sch 40 SA-214 carbon steel finned pipe, ½-inch-high fins, and ½-inch fin pitch×16-garage solid helical-welded carbon steel fins with a 1-inch horizontal clearances and a 1½-inch diagonal clearance. The second-stage heat exchanger 264, meanwhile, can consist of one long set of tube bundles, or multiple sets of tube bundles in series, depending upon the length of the second stage of the dryer. The tubes of the second-stage heat exchanger 264 will generally consist of 1-1½-inch OD tubing×10 BWG wall SA-214 carbon steel finned pipe, ¼-½-inch-high fins, and ½-¾-inch fin pitch× 16-gauge solid helical-welded carbon steel fins with 1-inch horizontal clearance and 1½-inch diagonal clearance. In an embodiment of this invention, the second-stage heating coil pipes contain 110-140 tubes running the length of the second stage. The combined surface area of the tube bundles for both the first-stage and second-stage heat exchangers 258 and 264 is approximately 8,483 $ft^2$.

The heat source provided to the fluidized bed under the present invention may be primary heat. More preferably, the heat source should be a waste heat source like hot condenser cooling water, process waste heat, hot flue gas, or spent turbine steam, which may be used alone or in combination with another waste heat source(s) or primary heat. Such waste heat sources are typically available in many if not most industrial plant operations, and therefore may be used to operate the contaminant separation process of the present invention on a more commercially economical basis, instead of being discarded within the industrial plant operation. U.S. Ser. No. 11/107,152 filed on Apr. 15, 2005, which shares a common co-inventor and owner with this application, describes more fully how to integrate such primary or waste heat sources into the fluidized bed apparatus, and is incorporated hereby by reference in its entirety.

It has been found surprisingly that the concentration of sulfur and mercury contaminants contained within the undercut streams 260, 268, and 270 are significantly greater than that of wet coal feed stream 12. Likewise, the elutriated fines stream 166 exiting the top of the fluidized-bed dryer is enhanced in the presence of contaminants like fly ash, sulfur, and mercury. By using the particle segregation method of the present invention, the mercury concentration of the coal product stream 168 can be reduced by approximately 27%, compared with the mercury concentration of the wet coal feed stream 12. Moreover, the sulfur concentration of the coal product stream 168 can be reduced by approximately 46%, and the ash concentration can be reduced by 59%. Stated differently, using the present invention, approximately 27-54% of the mercury appearing in the wet coal feed can be concentrated in the undercut and elutriated fines output streams, and therefore removed from the coal product stream that will go to the boiler furnace. For sulfur and ash, the corresponding values are 25-51% and 23-43%, respectively. By concentrating the contaminants within the undercut stream in this manner, and significantly reducing the presence of the contaminants in the coal product stream 168 going to the boiler furnace for combustion, there will be less mercury, $SO_2$ and ash contained within the resulting flue gas, and therefore less burden on the scrubber technology conventionally used within industrial plant operations to treat the flue gas stream before it is vented to the atmosphere. This can result in significant operational and capital equipment cost savings for a typical industrial plant operation.

The fluidized bed designs for this invention are intended to be custom designed to maximize use of waste heat streams available from a variety of power plant processes without exposing the coal to temperatures greater than 300° F., preferably between 200-300° F. Other feedstock or fuel temperature gradients and fluid flows will vary, depending upon the intended goal to be achieved, properties of the fuel or feedstock and other factors relevant to the desired result. Above 300° F., typically closer to 400° F., oxidation occurs and volatiles are driven out of the coal, thereby producing another stream containing undesirable constituents that need to be managed, and other potential problems for the plant operations.

The fluidized-bed dryers are able to handle higher-temperature waste heat sources by tempering the air input to the dryer to less than 300° F. and inputting this heat into heat exchanger coils within the bed. The multi-stage design of a fluidized-bed dryer creates temperature zones which can be used to achieve more efficient heat transfer by counter flowing of the heating medium. The coal outlet temperature from a dryer bed of the present invention is relatively low (typically less than 140° F.) and produces a product which is relatively easy to store and handle. If a particular particulate material requires a lower or higher product temperature, the dryers can be designed to provide the reduced or increased temperature.

Figure 19:
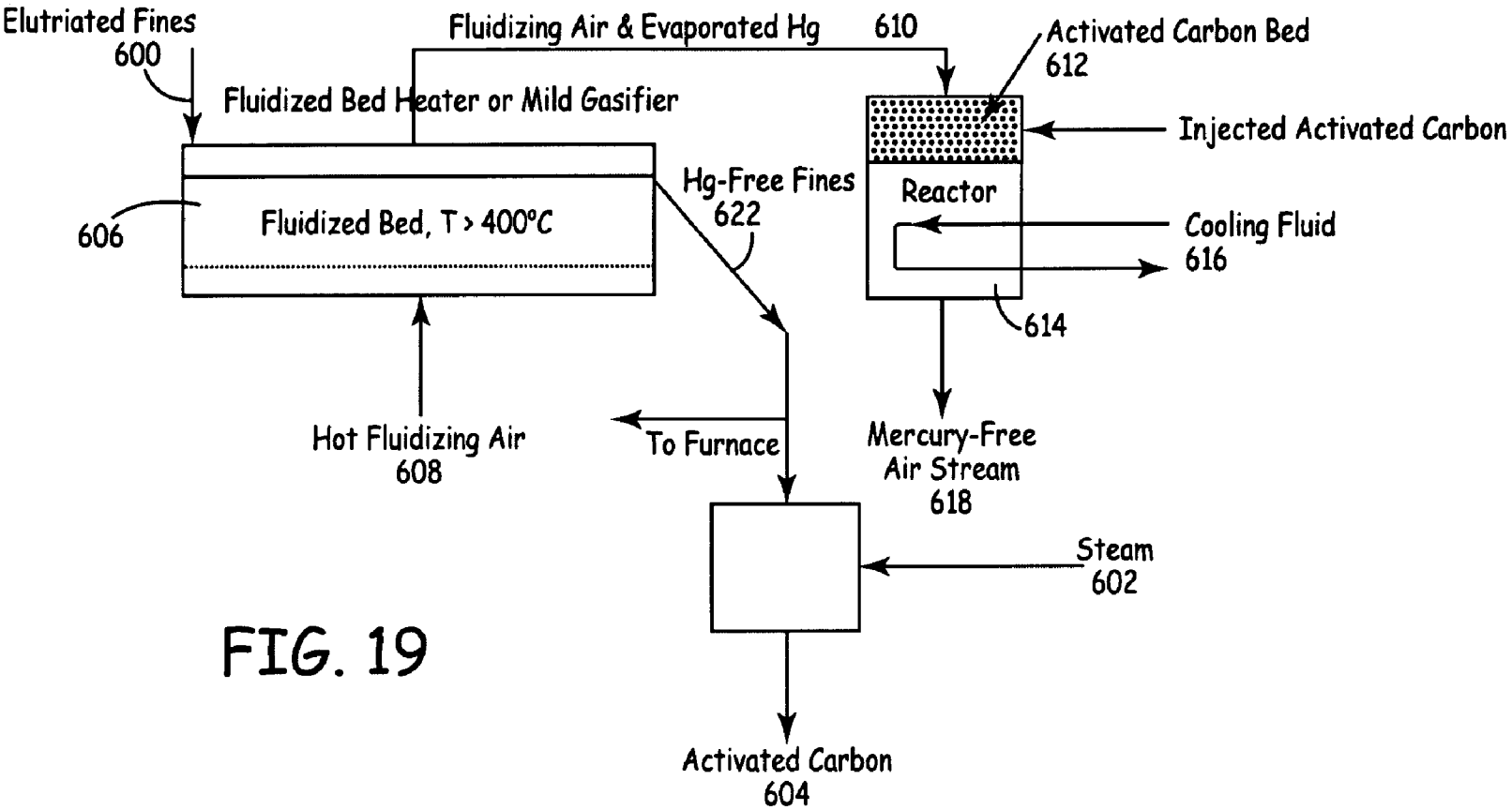
FIG. 19 is a schematic diagram of a fluidized bed dryer in combination with means for separating contaminates from coal fines.

Elutriated particles 600 collected by particle-control equipment are typically very small in size and rich in fly ash, sulfur, and mercury. FIG. 19 is a schematic drawing indicating a process for removing mercury through the use of activated steam 602 to produce activated carbon 604. As shown in FIG. 19, elutriated particle stream 600 is heated in a fluidized-bed heater or mild gasifier 606 to a temperature of 400° F. or higher to evaporate the mercury. Fluidizing air 608, forced through the fluidized bed 608, drives out the mercury into overhead stream 610. Evaporated mercury in overhead stream 610 can be removed by existing commercially available mercury control techniques, for example, by activated carbon injected into the air stream, or the mercury-laden air stream 610 may be passed though a bed of activated carbon 612 as illustrated in FIG. 19. Since mercury concentration in the treatment stream 610 will be much higher compared to the flue gas 306 leaving the furnace 330, and the total volume of the air stream that needs to be treated is very small compared to the flue gas leaving the furnace, this will be a very efficient mercury removal process. A heat exchanger 614 through which cooling fluid 616 is circulated, may be used to cool hot mercury-free stream 618. Heat can be harvested in the cooling process and used to preheat fluidization air 620 to the fluidized bed heater or mild gasifier 606. The mercury-free fines 622 can be burned in the furnace 330 or, as illustrated in FIG. 19, can be activated by steam 602 to produce activated carbon 604. The produced activated carbon 604 can be used for mercury control at the coal-drying site or can be sold to other coal-burning power stations.

Figure 20:
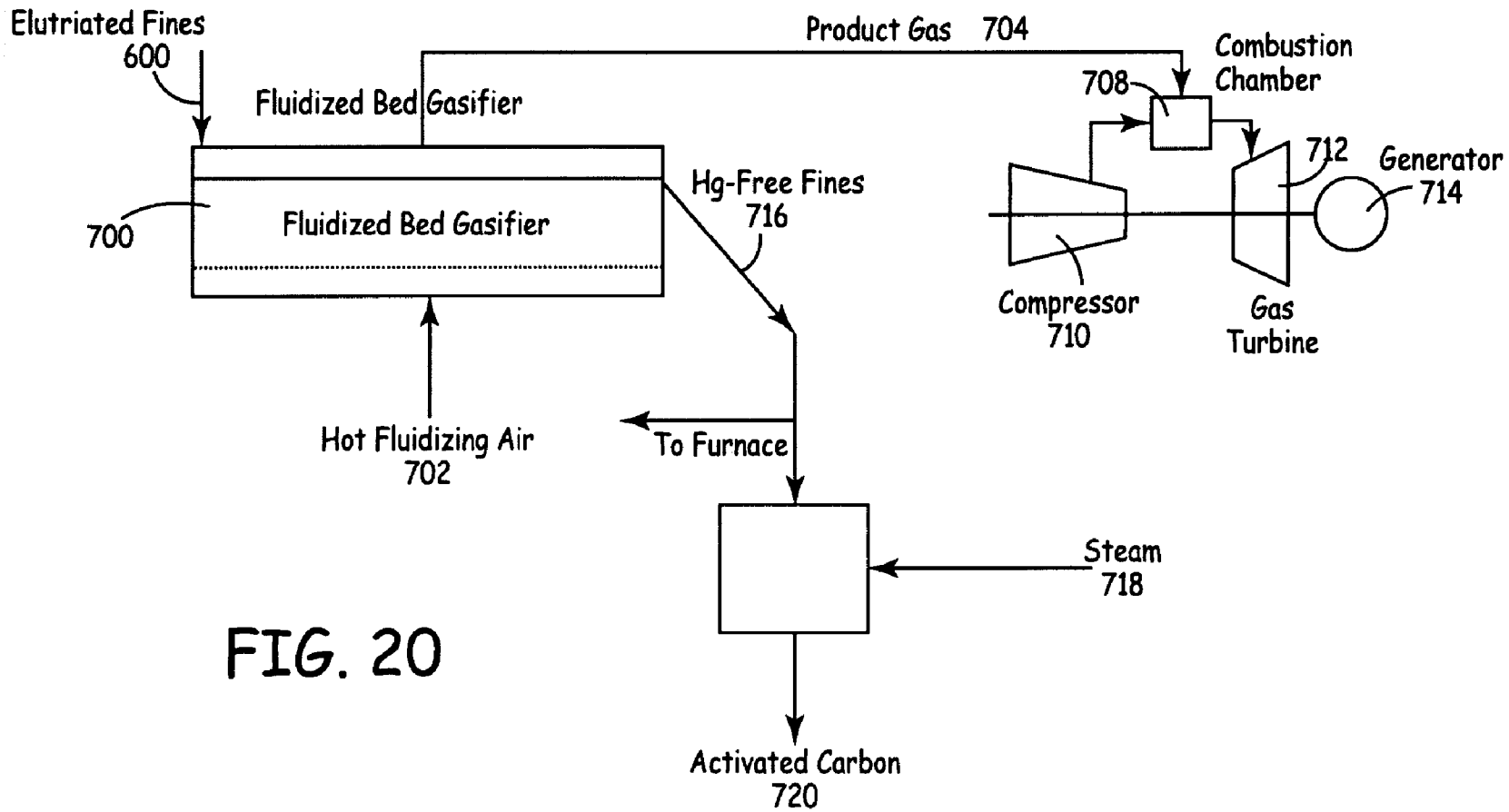
FIG. 20 is a schematic diagram of a fluidized bed dryer in combination with means for separating contaminates from coal fines and burning the contaminates to generate power.

FIG. 20 illustrates a process for gasifying elutriated fines 600. Elutriated particle stream 600 is gasified in fluid bed gasifier 700 in combination with fluidizing air 702. A gasifier is typically utilized at a higher temperature, such as 400° F., where combustible gases and volatiles are driven off. The product gas stream 704 is combusted in a combustion turbine 706 consisting of a combustion chamber 708, compressor 710, gas turbine 712 and generator 714. The remaining char 716 in the fluidized-bed gasifier will be mercury-free, and can be burned in the existing furnace 330 or treated by steam 718 to produce activated carbon 720.

The undercut streams can also be rich in sulfur and mercury. These streams can be removed from the process and land-filled or further processed in a manner similar to the elutriated fines stream, to remove undesirable impurities.

Figure 21A:
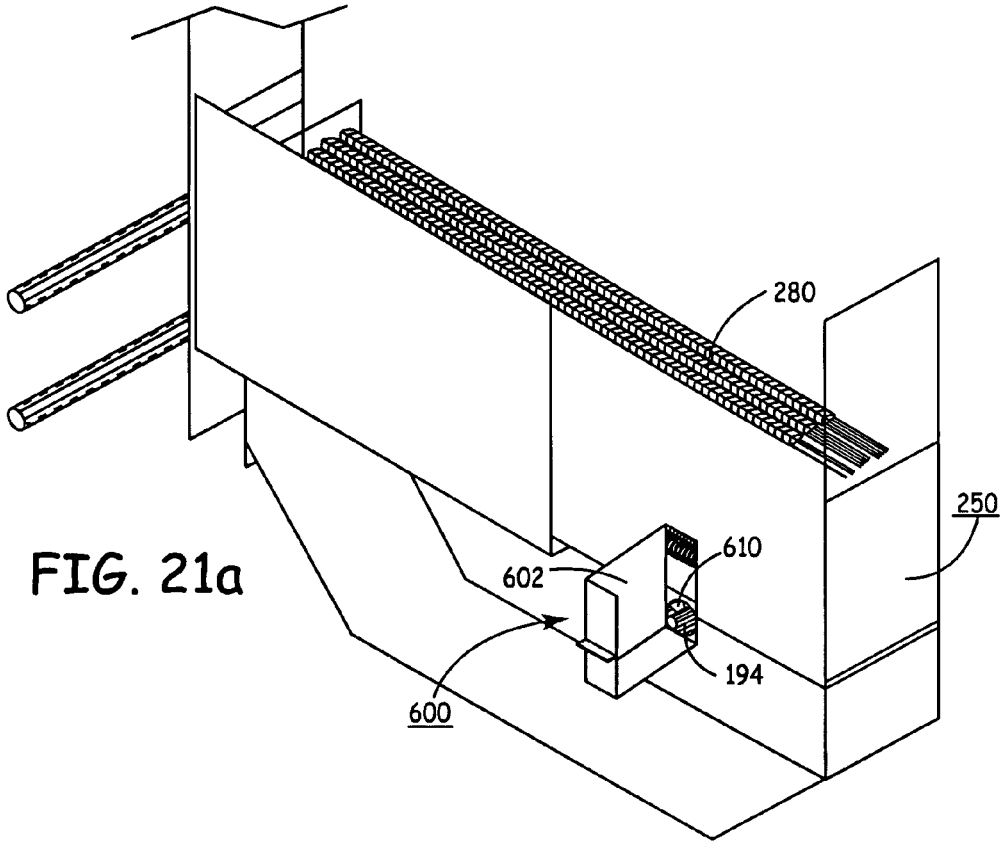
FIG. 21*a* and 21*b* are perspective cut-away views of the scrubber assembly used to remove undercut particulate from the fluidized-bed dryer.
Figure 21B:
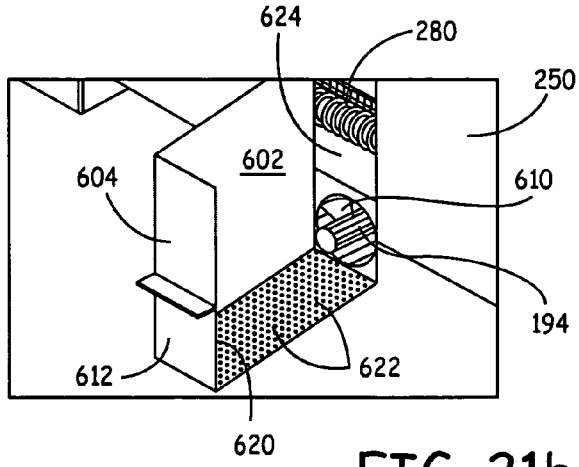

In a preferred embodiment of the present invention, the undercut coal particle stream 170 or 260 is conveyed directly to a scrubber assembly 600 for further concentration of the contaminants by removal of fine coal particles trapped therein. An embodiment of the scrubber assembly 600 of the present invention is shown in a cut-away view in FIGS. 21*a* and 21*b*. The scrubber assembly 600 is a box-like enclosure having side walls 602, an end wall 604, bottom 606, and top 608 (not shown), and is attached to the dryer 250 sidewall to encompass an undercut discharge port 610 through which the screw auger 194 partially extends. It should be noted that any other appropriate device that is capable of conveying the undercut coal particles in a horizontal manner could be substituted for the screw auger, including a belt, ram, or drag chain.

The screw auger 194 will move the undercut particles lying near the bottom of the fluidized bed across the bed, through undercut discharge part 610, and into scrubber assembly 600 where they can accumulate separate and apart from the fluidized dryer. Distributor plate 620 is contained within the scrubber assembly 600. A substream of hot fluidizing air 206 passes upwardly through holes 622 in distributor plate 620 to fluidize the undercut particle stream contained within the scrubber assembly. Of course, the undercut particles will reside near the bottom of the fluidized bed due to their greater specific gravity, but any elutriated fines trapped amongst these undercut particles will rise to the top of the fluidized bed, and be sucked back into the fluidized dryer bed 250 through inlet hole 624 (the heat exchanger coils 280 are shown through this hole in FIG. 22). In this manner, the undercut particles stream is further processed within the scrubber assembly of FIG. 21 to clean out the elutriated fines, thereby leaving an undercut coal particle stream that has a greater concentration of contaminants, and allowing the fines which are lower in contaminants to be returned to the fluidized bed for further processing.

When the undercut particles contained within the scrubber assembly have accumulated to a sufficient degree, or are otherwise needed for another purpose, gate 612 in end wall 604 may be opened to allow the accumulated undercut particles to be discharged through an outlet hole in the end wall wherein these undercut particles are pushed by the positive pressure of the imposed by screw auger 294 on the undercut particles through them, or by other suitable mechanical conveyance means. Gate 612 could also be operated by a timer circuit so that it opens on a periodic schedule to discharge the accumulated undercut particles.

Figure 22:
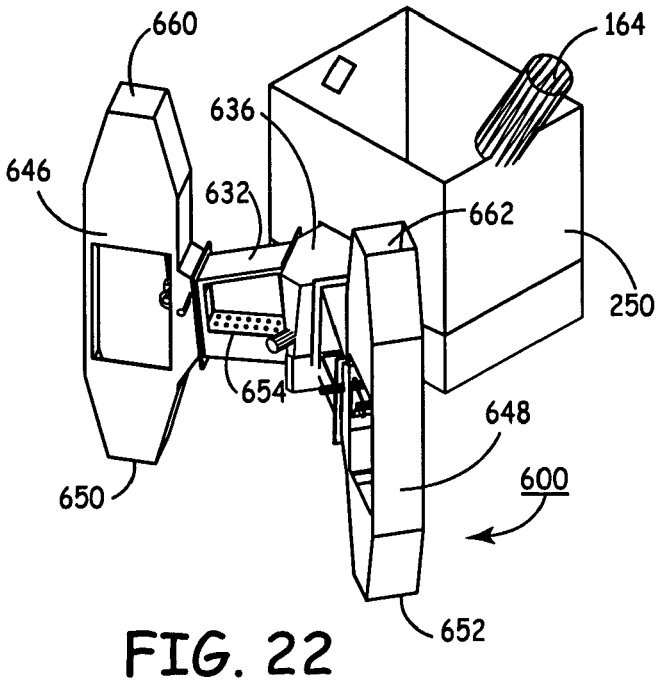
FIG. 22 is perspective view of another scrubber assembly embodiment of the present invention.
Figure 23:
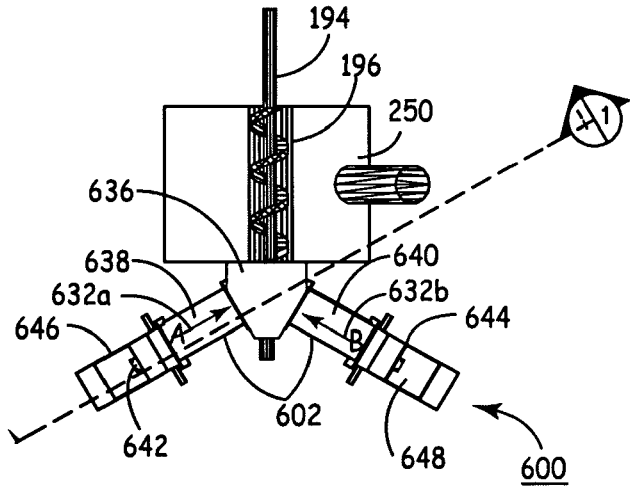
FIG. 23 is a plan view of the scrubber assembly of FIG. 22.
Figure 24:
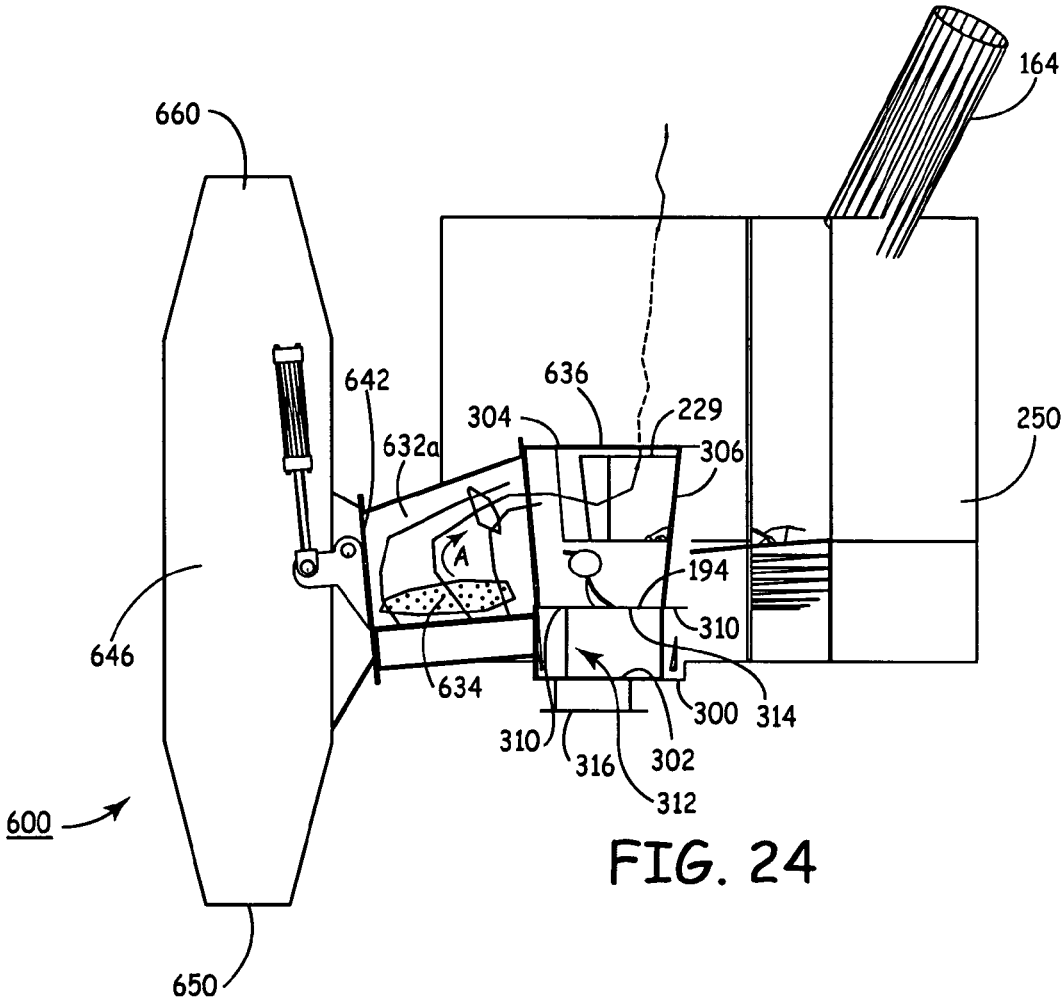
FIG. 24 is an enlarged perspective view of a portion of the scrubber assembly shown in FIG. 22.

Yet another embodiment 630 of the scrubber assembly is shown in FIGS. 22-24, constituting two scrubber subassemblies 632 and 634 for handling larger volumes of undercut particles produced by the fluidized-bed dryer 250. As can be seen more clearly in FIG. 24, screw auger 194 extends through vestibule 636. Undercut coal particles are conveyed by screw auger 194 to this vestibule 636 and then into collection chambers 638 and 640 which terminate in gates 642 and 644, respectively, or other appropriate type of flow control means.

Figure 26:
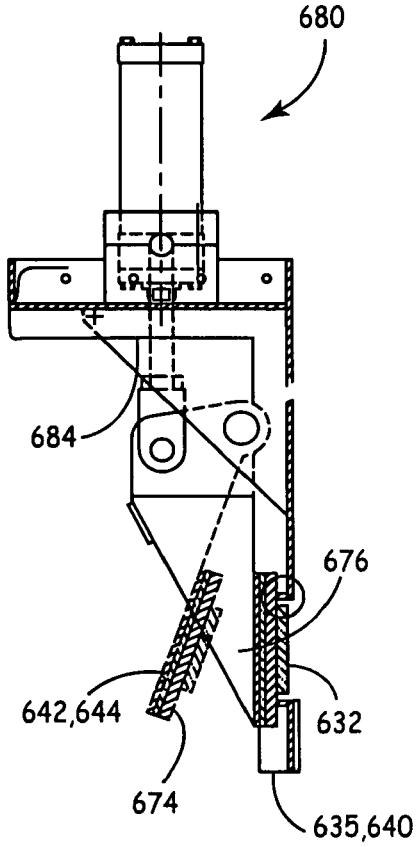
FIG. 26 is a cross section view of the gate according to an example embodiment of the present invention.

As discussed above, distributor plates 654 and 656 may be included inside the collection chambers 638 and 640 (see FIG. 26) so that a fluidizing airstream passed through holes 658 and 660 in the distributor plates fluidize the undercut particles to separate any elutriated fines trapped amongst the denser undercut particles. Once gates 642 and 644 are opened, the elutriated fines will rise to the tops of chutes 646 and 648 through holes 660 and 662 for conveyance by suitable mechanical means back to the fluidized bed dryer 250. The undercut particles will drop through the bottom of chutes 646 and 648, as previously described.

Once a predetermined volume of undercut particles have accumulated within the collection chambers 638 and 640, or a predetermined amount of time has elapsed, then gates 642 and 644 are opened to permit the undercut particles to be discharged into chutes 646 and 648, respectively. The undercut particles will fall by means of gravity through outlet parts 650 and 652 in the bottom of chutes 646 and 648 into some other storage vessel or conveyance means for further use, further processing, or disposal.

Gates 642 and 644 may be pivotably coupled to the collection chambers 638 and 640, although these gates may also be slidably disposed, upwardly pivoting, downwardly pivoting, laterally pivoting, or any other appropriate arrangement. Additionally, multiple gates may be operatively associated with a collection chamber to increase the speed of discharge of the undercut coal particles therefrom.

Figure 25:
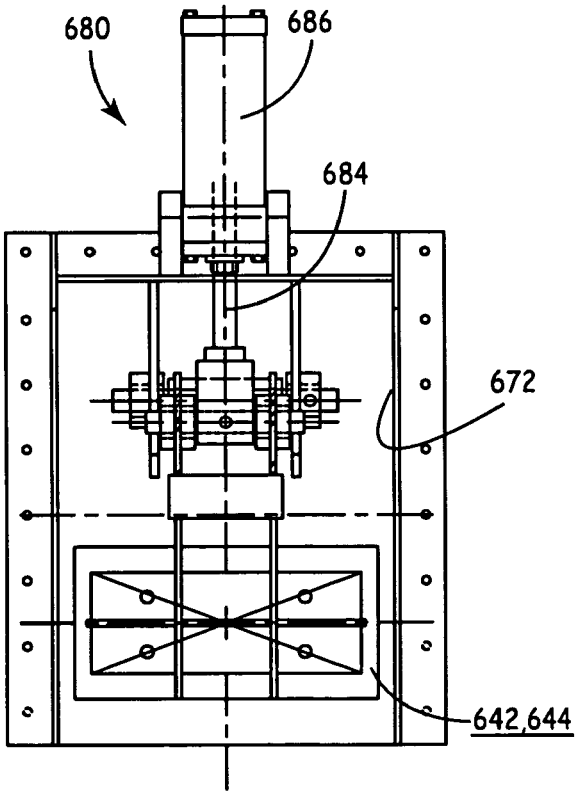
FIG. 25 is an end view of a gate or material flow regulator of a scrubber assembly according to an example embodiment of the present invention.

In an example embodiment, as illustrated in FIG. 25, gate 642 or 644 could include a planar door portion 672 that covers discharge port 632 of collection chamber 638, 640. Door portion 672 may have an area greater than an area of discharge port 632. Door portion 672 may comprise any rigid material such as steel, aluminum, iron, and like materials with similar physical characteristics. In an alternate embodiment, gate 670 will be repeatedly operated, it may be advantageous to use a thinner material, which can reduce its weight. In this embodiment, the door portion 672 may also include bracing or supports (not shown) to add additional support against any outwardly acting pressure from within collection chamber 638, 640.

Gate 670 also includes at least one seal portion 674 disposed on or to an inner surface of door portion 672 to form a generally positive seal over discharge opening 632. Seal portion 674 could have an area greater than an area of discharge opening 632. Seal member 674 could comprise any resiliently compressible material such as rubber, an elastic plastic, or like devices having similar physical characteristics.

A cover 676 may be disposed on seal member 672 to protect or cover it from the fluidized and non-fluidized material that will confronting seal gate 670. As particularly illustrated in FIG. 26, cover 676 comprises a sheet having an area that can be less than an area of discharge opening 632. When gate 670 is in its closed position cover 676 is nested in discharge port 632. Cover 676 can comprise any rigid material such as steel, aluminum, iron, and like materials with similar physical characteristics. However, other materials may also be utilized for cover 676.

In an example embodiment, an actuation assembly 680 is operatively coupled to gate 670 to move it from an open position and a closed position, whereby the coal is dischargeable from fluidizing collector 620 when gate 670 is in the open position. Actuation assembly 280 comprises a pneumatic piston rod 684 and cylinder 686 that are in operative communication with a fluid pneumatic system (not shown). The fluid pneumatic system may include the utilization of fluid heat streams such as waste heat streams, primary heat streams, or a combination to the two.

Since fluidization will be occurring in the fluidizing collector 632, construction materials may be used that are able to withstand the pressures needed to separate the fine particulates from the denser and/or larger contaminated material. Such construction material can include steel, aluminum, iron, or an alloy having similar physical characteristics. However, other materials may also be used to manufacture the fluidizing collection chamber 638, 640.

The fluidizing collection chamber 638, 640 can also, although not necessary, include an in-collector heater (not shown) that may be operatively coupled to a fluid heat stream to provide additional heat and drying of the coal. The in-collector heater may be fed by any fluid heat stream available in the power plant including primary heat streams, waste streams, and any combination there.

As illustrated in FIGS. 23 and 24, the top wall 632*a* and 632*b* of fluidizing collection chamber 638, 640 may traverse away from the fluidized bed at an angle such that the fluid heat stream entering the fluidizing collection chamber 638, 640 is directed toward passage A or second passage B, as indicated by reference arrows A and B, and into the fluidized bed. An inner surface of the top wall 632 can include impressions, or configurations such as channels, indentations, ridges, or similar arrangements that may facilitate the flow of the fluidized particulate matter through passage A or second passage B and into the fluidized bed.

Figure 27:
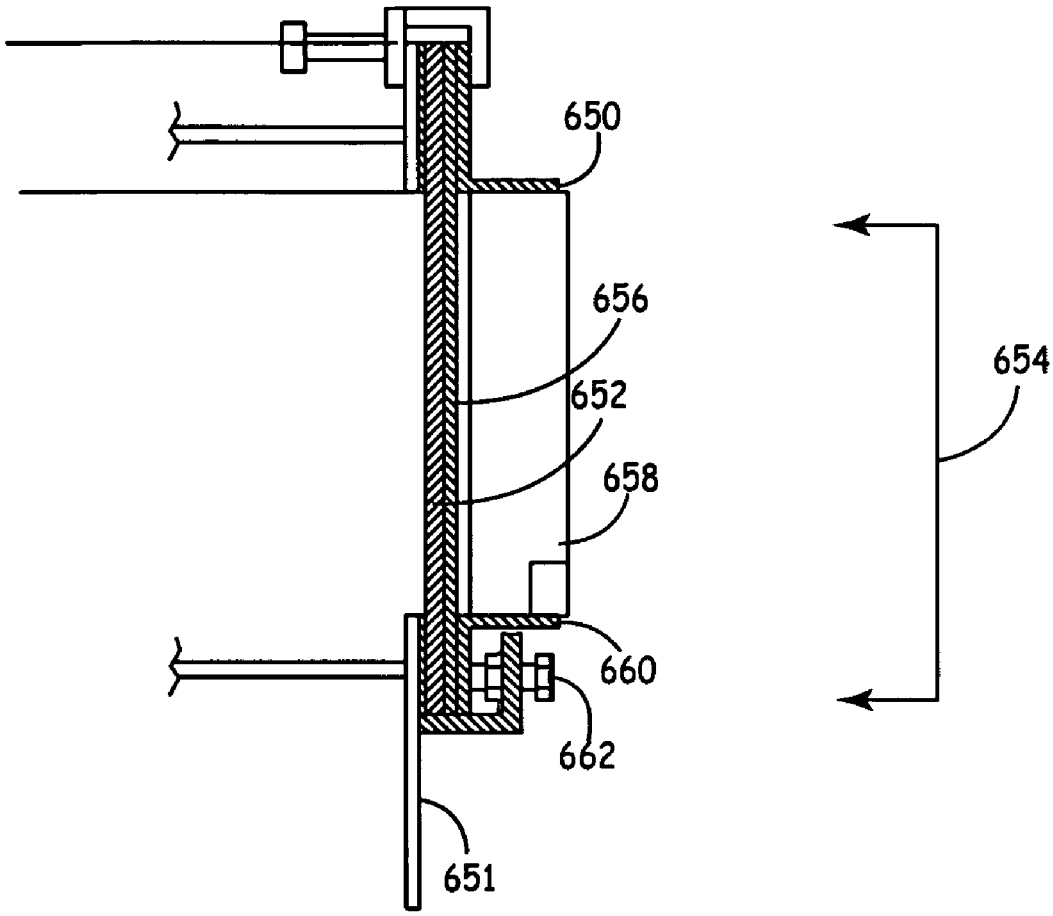
FIG. 27 is a cross-sectional view of a window assembly.

Referring to FIGS. 22 and 27, a window assembly 650 may be disposed on the peripheral wall 651 to permit viewing of the fluidization occurring within the interior of the fluidizing collection chamber 638, 640. In an example embodiment of the present invention, the window assembly 650 comprises at least an inner window 652 comprising a transparent and/or shatter resistant material such as plastic, thermoplastic, and like materials fastened to and extending across a window opening 654. A support or plate 656 may be disposed to a perimeter outer surface of the inner window 652 to provide support against outwardly acting pressure against the inner window 652. The support 656 may comprise any substantially rigid material such as steel, aluminum, or like material. A second or outer widow 658 may be disposed to an outer surface of the support 656 to provide additional support against outwardly acting pressures within the fluidizing collection chamber 638, 640. A bracket 660 and fastener 662 may be utilized to secure window assembly 650 into place. Bracket 660 may comprise an L-shape, C-shape, or similar shape that is capable of securing the window assembly 650. Fastener 662 may comprise a bolt, screw, c-clamp, or any fastener known to one skilled in the art.

Junction 300 comprises a bottom wall 302, a top wall 304 and a plurality of side walls 306 defining an interior 308. A distributor plate 310 is spaced a distance from the bottom wall 302 of junction 300 defining a plenum 312 for receiving at least one fluid heat stream that flows into the plenum 312 through at least one inlet 316. Distributor plate 312 of junction 300 is preferably sloped or angled toward fluidizing collector 220 to assist in the transport of non-fluidized material from the fluidized dryer bed 130. As the non-fluidized material travels through junction 300, apertures 314 extending through distributor plate 310 to diffuse a fluid heat stream through the non-fluidized material; thereby causing the separation of fine particulate material. The fine particulate material becomes fluidized and flows back into the interior 106 of fluidized dryer bed 130. The apertures 314 extending through distributor plate 310 of junction 300 may be angled during manufacturing to control a direction of the fluid heat stream.

Use of the undercut particles separated from the dryer 250 by the scrubber assembly 600 will depend upon its composition. If these undercut particles contain acceptable levels of sulfur, ash, mercury, and other undesirable constituents, then they may be conveyed to the furnace boiler for combustion, since they contain desirable heat values. If the undesirable constituents contained within these undercut particles are unacceptably high, however, then the undercut particles may be further processed to remove some or all of the levels of these undesirable constituents, as disclosed more fully in U.S. Ser. Nos. 11/107,152 and 11/107,153, both of which were filed on Apr. 15, 2005 and share a common co-inventor and co-owner with this application, and are incorporated hereby. Only if the levels of undesirable constituents contained within the undercut particles are so high that they cannot be viably reduced through further processing will the undercut particles be disposed of in a landfill, since this wastes the desirable heat values contained within the undercut particles. Thus, the scrubber assembly 600 of the present invention not only allows the undercut coal particles stream to be automatically removed from the fluidized bed to enhance the efficient and continuous operation of the dryer, but also permits these undercut particles to be further processed and productively used within the electricity generation plant or other industrial plant operation.

The following examples illustrate the low-temperature coal dryer that forms a part of the present invention.

EXAMPLE I

Effect of Moisture Reduction on the Coal Composition

PRB coal and lignite coal samples were subjected to chemical and moisture analysis to determine their elemental and moisture composition. The results are reported in Table 1 below. As can be seen, the lignite sample of coal exhibited on average 34.03% wt carbon, 10.97% wt oxygen, 12.30% wt fly ash, 0.51% wt sulfur, and 38.50% wt moisture. The PRB subbituminous coal sample meanwhile exhibited on average 49.22% wt carbon, 10.91% wt oxygen, 5.28% wt fly ash, 0.35% wt sulfur, and 30.00% moisture.

An "ultimate analysis" was conducted using the "as-received" values for these lignite and PRB coal samples to calculate revised values for these elemental composition values, assuming 0% moisture and 0% ash ("moisture and ash-free"), and 20% moisture levels, which are also reported in Table 1. As can be seen in Table 1, the chemical compositions and moisture levels of the coal samples significantly change. More specifically for the 20% moisture case, the lignite and PRB coal samples exhibit large increases in carbon content to 44.27% wt and 56.25% wt, respectively, along with smaller increases in oxygen content to 14.27% wt and 12.47% wt, respectively. The sulfur and fly ash constituents increase slightly too (although not on an absolute basis). Just as importantly, the heat value (HHV) for the lignite coal increased from 6,406 BTU/lb to 8,333 BTU/lb, while the HHV value for the PBR coal increased from 8,348 BTU/lb to 9,541 BTU/lb.

TABLE 1

| | | As-Received | | Moisture & Ash-Free | | 20% Fuel Moisture | |
|---|---|---|---|---|---|---|---|
| | Units | Lignite | PRB | Lignite | PRB | Lignite | PRB |
| Carbon | % wt | 34.03 | 49.22 | 69.17 | 76.05 | 44.27 | 56.25 |
| Hydrogen | % wt | 2.97 | 3.49 | 6.04 | 5.39 | 3.87 | 3.99 |
| Sulfur | % wt | 0.51 | 0.35 | 1.04 | 0.54 | 0.67 | 0.40 |
| Oxygen | % wt | 10.97 | 10.91 | 22.29 | 16.86 | 14.27 | 12.47 |
| Nitrogen | % wt | 0.72 | 0.75 | 1.46 | 1.16 | 0.92 | 0.86 |
| Moisture | % wt | 38.50 | 30.00 | 0.00 | 0.00 | 20.00 | 20.00 |
| Ash | % wt | 12.30 | 5.28 | 0.00 | 0.00 | 16.00 | 6.30 |
| TOTAL | % wt | 100.00 | 100.00 | 100.00 | 100.00 | 100.00 | 100.00 |
| HHV | BTU/lb | 6,406 | 8,348 | 13,021 | 12,899 | 8,333 | 9,541 |
| $H^T_{fuel}$ | BTU/lb | −2,879 | 2,807 | | | −1,664 | −2,217 |

EXAMPLE II

Pilot Dryer Coal Particle Segregation Results

During the Fall of 2003 and Summer of 2004, over 200 tons of lignite was dried in a pilot fluidized bed coal dryer built by Great River Energy at Underwood, N. Dak. The dryer capacity was 2 tons/hr and was designed for determining the economics of drying North Dakota lignite using low-temperature waste heat and determining the effectiveness of concentrating impurities such as mercury, ash and sulfur using the gravimetric separation capabilities of a fluidized bed.

Coal streams in and out of the dryer included the raw coal feed, processed coal stream, elutriated fines stream and the undercut. During tests, coal samples were taken from these streams and analyzed for moisture, heating value, sulfur, ash and mercury. Some of the samples were sized and further analysis was done on various size fractions.

The pilot coal dryer was instrumented to allow experimental determination of drying rates under a variety of operating conditions. A data collection system allowed the recording of dryer instruments on a 1-minute bases. The installed instrumentation was sufficient to allow for mass and energy balance calculations on the system.

Figure 28:
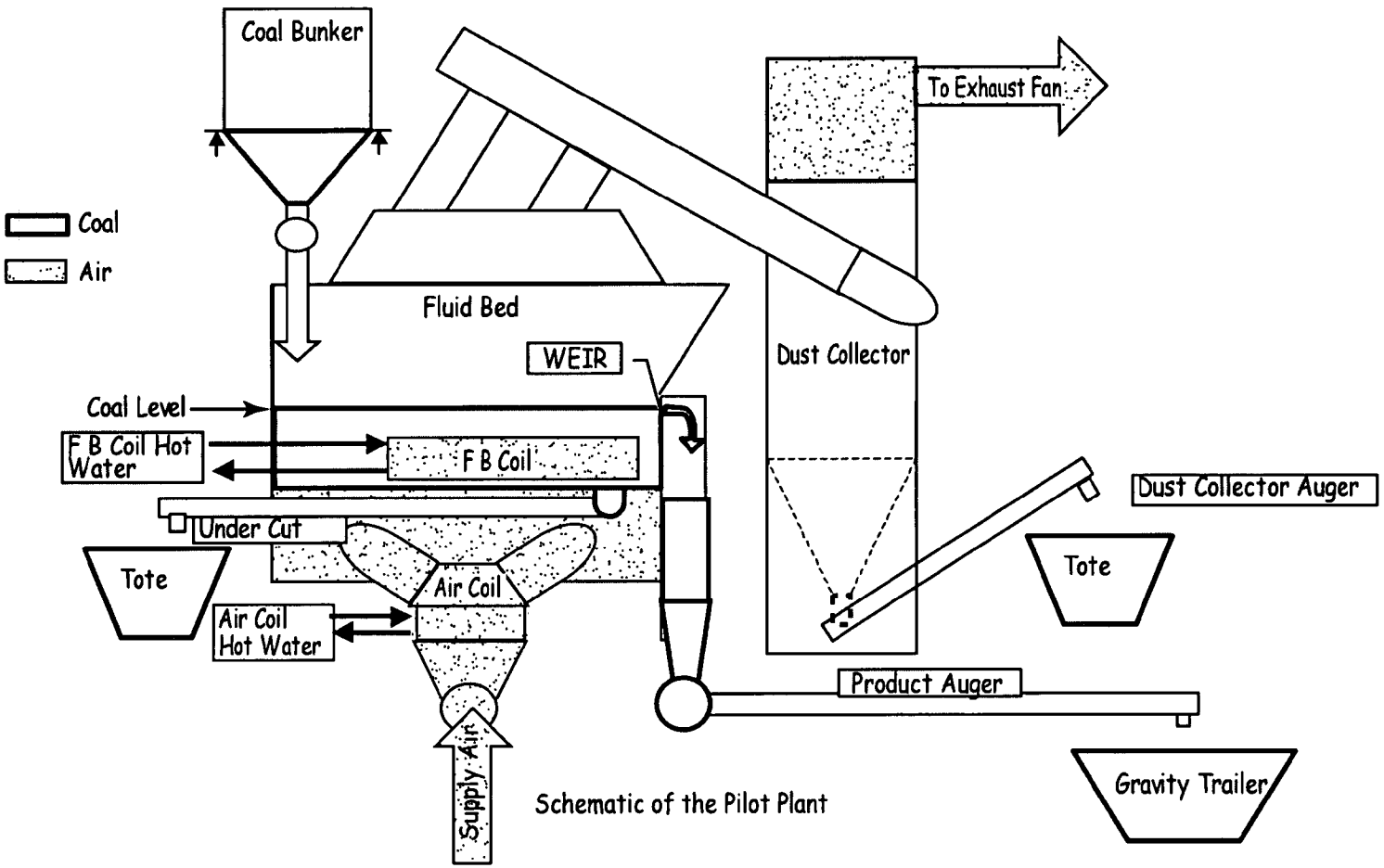
FIG. 28 is a schematic of a two-stage fluidized-bed pilot dryer of the present invention.
Figure 29:
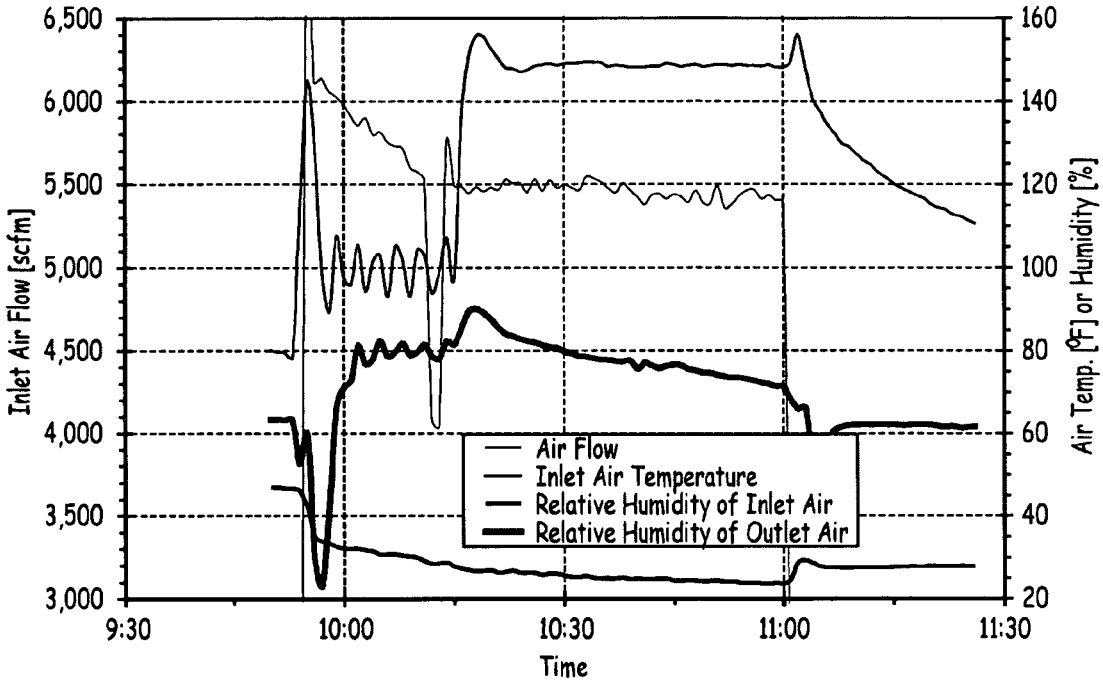
FIGS. 29-30 are graphical depictions of several operational characteristics of the fluidized-bed dryer of FIG. 28.
Figure 30:
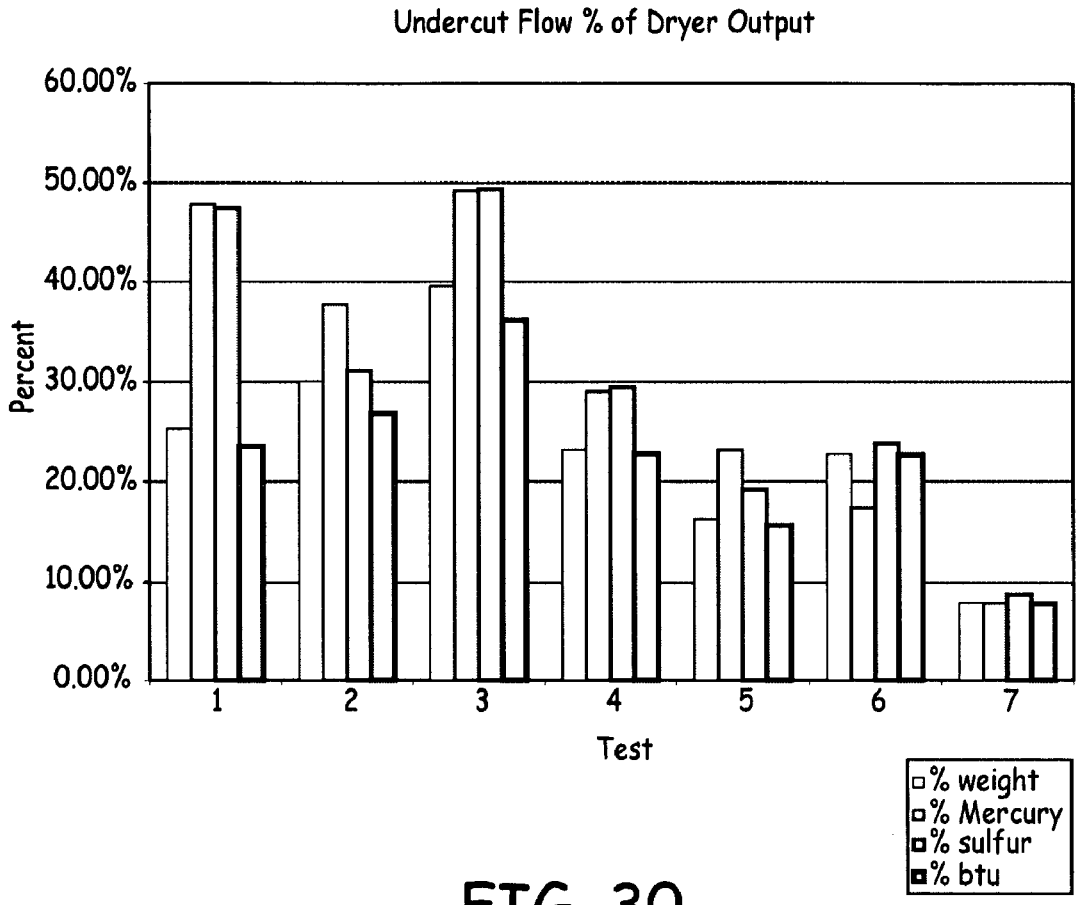

The main components of the pilot dryer were the coal screen, coal delivery equipment, storage bunker, fluidized bed dryer, air delivery and heating system, in-bed heat exchanger, environmental controls (dust collector), instrumentation, and a control and data acquisition systems (See FIG. 28). Screw augers were used for feeding coal in and products out of the dryer. Vane feeders are used to control feed rates and provide air lock on the coal streams in and out of the dryer. Load cells on the coal burner provided the flow rate and total coal input into the dryer. The undercut and dust collector elutriation were collected in totes which were weighted before and after the test. The output product stream was collected in a gravity trailer which was equipped with a scale. The coal feed system was designed to supply ¼-minus coal at up to 8000 lbs/hr to the dryer. The air system was designed to supply 6000 SCFM @ 40 inches of water. An air heating coil inputted 438,000 BTU/hr and the bed coil inputted about 250,000 BTUs/hr. This was enough heat and air flow to remove about 655 lbs of water per hour.

Typical tests involved filling the coal bunker with 18,000 lbs of ¼" minus coal. The totes would be emptied and the gravity trailer scale reading recorded. Coal samples on the feed stock were collected either while filling the bunker or during the testing at the same time interval as the dust collector, undercut and gravity trailer samples (normally every 30 minutes after achieving steady state.) The dust collector and all product augers and air locks were then started. The supply air fan was started and set to 5000 scfm. The coal feed to the dryer was then started and run at high speed to fill the dryer. Once the bed was established in the dryer, the air temperature was increased, heating was lined up to the bed coil, and the air flow adjusted to the desired value. The tests were then run for a period of 2-3 hours. One test was run for eight hours. After the test, the totes were weighed and the gravity trailer scale reading recorded. Instrument reading from the test was transferred to an excel spread sheet and the coal samples taken to the lab for analysis. The totes and gravity trailer were then emptied in preparation for the next test.

During the Fall of 2003, 150 tons of lignite was sent through the single-stage pilot dryer with a distributor area of 23.5 $ft^2$.in 39 different tests. Coal was fed into the fluidized bed at rates between 3000 to 5000 lbs/hr. Air flows were varied from 4400 (3.1 ft/sec) to 5400 (3.8 ft/sec) scfm. The moisture reduction in the coal is a function of the feed rate and the heat input to the drier. The 1st pilot module had the ability to remove about 655 lb water per hour at the design water temperatures of 200° F. Feeding coal at 83.3 lbs/min, one would expect a water removal rate of 0.13 lbs/lb coal.

During the Summer of 2004, the dryer was modified to two stages to improve non-fluidized particle removal, and a larger bed coil was installed. After modifying the dryer module, the drying capability was increased to about 750,000 BTU/hr with a water removal rate of 1100 lbs/hr. An additional 50 tons of coal was dried in the new module. The modified module also allowed for the collection of an undercut stream off the 1st stage. The undercut was non-fluidized material which was removed from the bottom of the 1st stage. It was primarily made up of oversized and higher density material that was gravimetrically separated in the 1st stage. The total distributor plate area was 22.5 $ft^2$.

Table 2 shows the coal quality for the dryer feed, elutriation, undercut and product streams. The data indicates that the elutriation stream was high in mercury and ash, the undercut stream was high in mercury and sulfur, and the product stream experienced a significant improvement in heating value, mercury, ash, and # $SO_2$/mBTUs. The elutriation stream was primarily 40-mesh-minus and the undercut stream was 8-mesh-plus.

TABLE 2

Coal Feed Quality Verses Product Streams Test 44

| Coal | Pounds | Mercury ppb | Ash % | HHV BTUs/lb | Sulfur % | #$SO_2$/ mbtu |
|---|---|---|---|---|---|---|
| Feed | 14902 | 91.20 | 18.05 | 5830.00 | 0.53 | 1.82 |
| Undercut | 2714 | 100.61 | 15.41 | 6877.00 | 0.76 | 2.20 |
| Elutriation | 789 | 136.58 | 30.26 | 5433.75 | 0.50 | 1.86 |
| Product | 7695 | 65.83 | 14.22 | 7175.25 | 0.55 | 1.54 |

Therefore, Test 44 reduced the mercury and sulfur in the coal product stream by 40% and 15%, respectively.

Time variation of bed temperature, measured at six locations within the bed, and outlet air temperature are presented in FIG. 33. This information was used, along with the information on coal moisture content (obtained from coal samples) to close the mass and energy balance for the dryer and determine the amount or removed moisture from coal.

FIG. 34 shows the makeup of the undercut product for the 7 tests using the modified pilot dryer. Test 41 had the best results with containing 48% of the sulfur and mercury and only 23% of the btu and 25% of the weight. Applying the results from the air jig test in Module 4 we could expect to remove 37% of 48% for the mercury 18%, 27% of 48% for the sulfur 13% and 7.1 of 23% for BTU loss 1.6%.

EXAMPLE III

Some More Particle Segregation Results

Between September and December 2004, 115 tons of Canadian Lignite was dried at the modified, two-stage pilot dryer located at Underwood, N. Dak. Between 3 and 20 tons of material was run through the dryer during a daily test at flow rates of 2000-7000 lbs/hr. This produced coal with moisture levels of 15-24% from a 31% moisture feed stock.

Load cells on the coal bunker provided the flow rate and total coal input into the dryer. The undercut and dust collector elutriation was collected into totes, which were weighed before and after each test. The output product stream was collected in a gravity trailer, which was equipped with a scale. The coal feed system was designed to supply ¼-minus coal particles at up to 8000 lbs/hr to the dryer. The air system was designed to supply 6000 SCFM at 40 inches of water. An air heating coil input of 438,000 BTU/hr and a bed coil input of about 500,000 BTU/hr were applied to the dryer. This was enough heat and air flow to remove about 900 pounds of water per hour, depending upon ambient conditions and the temperature of the heating fluid.

The dryer output was typically 20% elutriation and undercut, and 80% product at 7000 lbs/hr flow rates with their percentage increasing as the coal flow to the dryer was reduced. Samples were collected off each stream during the tests and compared with the input feed. The undercut ("UC") flow was typically set at 420-840 lbs/hr. As the flow to the dryer was reduced, this became a larger percentage of the output stream. The elutriation stream also tended to increase as a percentage of the output as the coal flow was reduced. This was attributed to longer residence time in the dryer and higher attrition with lower moisture levels.

Typical tests involved filling the coal bunker with 18,000 pounds of ¼-inch-minus coal. Lignite coal sourced from Canadian Mine No. 1 was first crushed to 2-inch-minus. The material was then screened, placing the ¼-inch-minus material (50%) in one pile and the ¼-inch-plus material (50%) in another pile. The pilot dryer was then filled by adding alternating buckets from the two piles. The ¼-inch-plus material was run through a crusher prior to being fed up to the bunker, and the ¼-inch-minus material was fed in directly. Lignite coal sourced from Canadian Mine No. 2 was run directly through a crusher and into the pilot bunker without screening. Coal samples on the feed stock were collected from the respective stock piles. The dust collector ("DC"), undercut ("UC"), and gravity trailer ("GT") samples were taken every 30 minutes after achieving steady state. When running the large amounts of the Mine No. 1 coal through the dryer, samples were taken daily with a grain probe on the gravity trailer, DC tote, and UC tote.

The totes were emptied and the gravity scale reading recorded. The dust collector and all product augers and air locks were then started. The supply air fan was started and set to about 5000 SCFM. The coal feed to the dryer was then started and run at high speed to fill the dryer. Once the bed was established in the dryer, the air temperature was increased, heating water lined up to the bed coil, and the air flow adjusted to the desired value. The tests were then run for a period of 2-7 hours. The bed was not always emptied between tests and the nominal 3000 pounds of material accounted for in the results.

Tables 4-5 tabulate the results of the Canadian Lignite tests. Table 4 contains the dryer input, sum or the output streams, actual and calculated, based upon the change in total moisture and the input. Table 5 contains data on the three output streams for the Mine No. 1 Coal Tests.

TABLE 4

Test Summary

| Test | Dryer Input (lbs) | Actual Dryer Output (lbs) | Calculated Dryer Output (lbs) | Percent Difference |
|---|---|---|---|---|
| Test 49 on Mine No. 2 Coal | 6829 | 6088 | 6176 | 1.5 |
| Test 50 on Mine No. 2 Coal | 6871 | 5840 | 5522 | −5.4 |
| Test 52 on Mine No. 1 Coal | 108,517 | 95,474 | 95,474 | 0 |
| Test 57 on Mine No. 1 Coal | 38,500 | 33,206 | 32,931 | −0.8 |
| Test 58 on Mine No. 1 Coal | 7927 | 6396 | 6478 | 1.3 |
| Test 59 on on Mine No. 1 Coal | 27,960 | 25,320 | 25,278 | −0.2 |

TABLE 5

Mine No. 1 Coal Tests 52, 57, and 59 Results

| Output | Tot. Moisture | BTU | % Output | % BTU | % Sulfur | % Mercury | % Ash |
|---|---|---|---|---|---|---|---|
| 52DC | 19.53 | 7117 | 10.1 | 9.26 | 8.54 | 14.24 | 14.21 |
| 52UC | 20.3 | 7280 | 6.9 | 6.48 | 16.83 | 12.97 | 9.36 |
| 52GT | 21.93 | 7869 | 83.02 | 84.26 | 74.63 | 72.79 | 76.43 |
| 57DC | 20.1 | 6019 | 8.62 | 7.11 | 5.69 | 10.0 | 11.81 |
| 57UC | 16.4 | 5321 | 10.85 | 7.90 | 41.52 | 44.23 | 20.78 |
| 57GT | 19.65 | 7711 | 80.53 | 84.99 | 52.79 | 45.76 | 67.4 |
| 58DC | 18.43 | 6721 | 7.60 | 6.54 | 5.35 | 8.70 | 9.63 |
| 58UC | 12.40 | 6375 | 18.96 | 15.48 | 45.38 | 44.03 | 33.49 |
| 58GT | 16.09 | 8294 | 73.44 | 77.98 | 49.28 | 47.27 | 56.88 |
| 59DC | 23.24 | 6324 | 11.49 | 9.46 | 11.65 | N/A | 22.54 |
| 59UC | 30.14 | 6850 | 15.05 | 13.41 | 13.43 | N/A | 15.66 |
| 59GT | 22.42 | 8069 | 73.46 | 77.13 | 74.92 | N/A | 61.8 |

Tests 52, 57, 58, and 59 were conducted on the Mine No. 1 coal. Test 58 was a controlled test, and for Tests 52, 57, and 59 the bunker was being filled with coal during the dryer operation.

Test 52 was conducted for the purpose of removing about 25% of the water in the coal, and then bagging it for shipment to GTI for further testing. During this type of testing, we were filling the bunker at the same time material was being fed into the dryer, thereby making it difficult to track the input. For this test, the input was estimated by correcting the total output back to the coal feed total moisture. Test 52 was conducted on six separate days over a three-week period. After the second day of the test, the bed was not dumped, and the coal remained in the dryer for two-plus days in a fairly dry condition. This coal started smoldering in the UC tote and in the dryer bed. When the dryer was started, ignition took place, and several of the explosion panels needed to be replaced. The very dry condition of the coal and the period of time it sat, as well as the temperature of the bed when the unit was shut down contributed to this problem. We discontinued leaving coal in the dryer bed without proper cool down, and for not longer than one day. This seemed to eliminate the problem.

Tests 57, 58, and 59 were all one-day tests. During Tests 57 and 59, coal was added to the bunker during dryer operation, and we needed to estimate the coal feed. Test 57 was conducted at a coal inlet flow rate of about 7000 lbs/hr. Tests 58 and 59 were conducted at an inlet coal flow of about 5000 lbs/hr. The cooler temperature of early December had reduced the dryer's capacity. The mercury analyzer malfunctioned during Test 59.

The results of Table 5 provide good evidence that the UC stream is capable of removing a significant amount of the sulfur and mercury from the coal feed stream, while retaining the heat value of the coal feed stream.

The above specification, drawings, and examples provide a complete description of the structure and operation of the particulate material separator of the present invention. However, the invention is capable of use in various other combinations, modifications, embodiments, and environments without departing from the spirit and scope of the invention. Therefore, the description is not intended to limit the invention to the particular form disclosed.

We claim:

1. An apparatus for segregating particulate material by density and/or size to concentrate a contaminant for separation from the particulate material feed stream, comprising:

(a) a fluidizing bed having a receiving inlet for receiving the particulate material feed, an inlet opening for receiving a fluidizing stream, a discharge outlet for discharging a fluidized particulate material product stream, and a discharge outlet for discharging a non-fluidized particulate material stream;

(b) a source of fluidizing stream operatively connected to the inlet opening for introducing the fluidizing stream into the fluidizing bed to achieve separation of the fluidized particulate material product stream from the non-fluidized particulate material stream;

(c) a conveyor means for transporting the non-fluidized particulate material inside the fluidized bed through the discharge outlet to a reception means;

(d) wherein the fluidized particulate material product stream contains a reduction in the contaminant relative to the particulate material feed of about 23-54%, and the non-fluidized particulate material stream contains about 9-45% of the contaminant contained in the particulate material feed.

2. The particulate material segregating apparatus of claim 1, wherein the particulate material is coal.

3. The particulate material segregating apparatus of claim 1, wherein the contaminant is selected from the group consisting of fly ash, sulfur, mercury, and ash.

4. The particulate material segregating apparatus of claim 3, wherein the reduction of fly ash in the particulate material product stream is about 23-43%.

5. The particulate material segregating apparatus of claim 3, wherein the reduction of sulfur in the particulate material product stream is about 25-51%.

6. The particulate material segregating apparatus of claim 3, wherein the reduction of mercury in the particulate material product stream is about 27-54%.

7. The particulate material segregating apparatus of claim 1, wherein the fluidizing stream is air.

8. The particulate material segregating apparatus of claim 1, wherein the fluidizing stream is steam.

9. The particulate material segregating apparatus of claim 1, wherein the fluidizing stream is an inert gas.

10. The particulate material segregating apparatus of claim 1, wherein the fluidizing stream is heated by a heat source prior to its introduction to the fluidizing bed.

11. The particulate material segregating apparatus of claim 10, wherein the heat source is a primary heat source.

12. The particulate material segregating apparatus of claim 10, wherein the heat source is a waste heat source.

13. The particulate material segregating apparatus of claim 12, wherein the waste heat source is selected from the group consisting of hot condenser cooling water, hot stack gas, hot flue gas, spent process steam, and discarded heat from operating equipment.

14. The particulate material segregating apparatus of claim 10, wherein the temperature delivered to the fluidizing bed by the fluidizing stream does not exceed 300° F.

15. The particulate material segregating apparatus of claim 10, wherein the temperature delivered to the fluidizing bed by the fluidizing stream is between 200-300° F.

16. The particulate material segregating apparatus of claim 2, wherein the apparatus is used with respect to an electric power generating plant.

17. The particulate material segregating apparatus of claim 2, wherein the apparatus is used with respect to a coking plant.

18. The particulate material segregating apparatus of claim 1 further comprising a collection chamber operatively connected to the discharge outlet for the non-fluidized particulate material stream for receiving the non-fluidized particulate material stream, the collection chamber including a second fluidizing bed and means for directing a second fluidizing stream through the non-fluidized particulate material contained within the collection chamber for separating fluidizable particles therefrom to further concentrate the contaminant within the non-fluidized particulate material stream.

19. The particulate material segregating apparatus of claim 18, wherein the fluidizable particles separated from the non-fluidized particulate material stream in the collection chamber are returned to the first fluidizing bed by the second fluidizing stream.

20. An apparatus for segregating particulate by density and/or size including:

(a) a fluidizing bed having a particulate receiving inlet for receiving particulate to be fluidized, an opening for receiving a first fluidizing stream, an exit for fluidized particulate and an exit for non-fluidized particulate;

(b) a conveyor for conveying the non-fluidized particulate in the fluidizing bed to the non-fluidized particulate exit;

(c) a collector box positioned to receive the non-fluidized particulate exiting the fluidizing bed, said collector bed including means for directing a second fluidizing stream through the non-fluidized particulate as it is extracted from the collector box to separate fluidizable particulate therefrom; and (d) a source of fluidizing streams operatively connected to the fluidizing bed and collector.

21. The apparatus for segregating particulate of claim 20 wherein the fluidizable particulate separated from the non-fluidized material as it exits the collector box is directed back into the fluidizing bed by the fluidizing stream.

22. The apparatus for segregating particulate of claim 20 wherein the particulate is coal.

23. The apparatus for segregating particulate of claim 20 including one or more chutes aligned with the collector box for directionally controlling the flow of the non-fluidized coal exiting from the collector box.

24. The apparatus for segregating particulate of claim 20 including a chute aligned with the collector box for directionally controlling the flow of the non-fluidized coal exiting from the collector box, said chute including a first opening for directing the flow of the fluidizing stream exiting the collector box and a second opening for directing the flow of non-fluidized particulate exiting the collector box.

25. The apparatus for segregating particulate of claim 20 wherein the fluidizing stream is air.

26. The apparatus for segregating particulate of claim 20 wherein the means for directing a second fluid stream through the non-fluidized particulate is a collector distributor plate with angled apertures through which the fluidizing stream is directed into the non-fluidized particulate.

27. The apparatus for segregating particulate of claim 20 wherein the means for directing a second fluid stream through the non-fluidized particulate is a collector distributor plate with angled apertures through which the fluidizing stream is directed into the non-fluidized particulate, which collector distributor plate is inclined to assist in controlling flow of the fluidized and non-fluidized particulate.

28. An apparatus for segregating particulate of claim 20 further including a retractable gate preventing the non-fluidized particulate from exiting the fluidizing bed and collector box until opened.

29. The apparatus for segregating particulate of claim 20 wherein the means for directing a second fluid stream through the non-fluidized particulate is an inclined collector distributor plate with angled apertures through which the fluidizing stream is directed into the non-fluidized particulate, and wherein the flow of non-fluidized particulate from the fluidizing bed and through the collector box is controlled by one or more of the pressure of the fluidizing stream in the fluidizing bed, the collector box fluidizing streams and the incline of the collector distributor plate.

30. The apparatus for segregating particulate of claim 20 further comprising a bed distributor plate located near the bottom of the fluidizing bed for supporting particulate placed in the fluidizing bed, said distributor plate further arranged with valves creating a pattern of selectively oriented fluidizing streams within the bed for fluidizing particulate.

31. The apparatus for segregating particulate of claim 20 further comprising a bed distributor plate located near the bottom of the fluidizing bed for supporting particulate placed in the fluidizing bed, said distributor plate being arranged with a plurality of spaced, angled apertures creating multiple fluidizing streams within the bed for directing fluidizing streams through the particulate contained within the fluidizing bed.

32. The apparatus for segregating particulate of claim 20 further comprising a bed distributor plate located near the bottom of the fluidizing bed for supporting particulate placed in the fluidizing bed, said distributor plate formed to create inclined surfaces to encourage gravitational flow of the non-fluidized particulate towards the conveyor.

33. The apparatus for segregating particulate of claim 20 further comprising a bed distributor plate located near the bottom of the fluidizing bed for supporting particulate placed in the fluidizing bed, said bed distributor plate defining a plenum below the inclined bed distributor plate where the fluidizing stream enters before being distributed throughout the fluidizing bed.

34. The apparatus for segregating particulate of claim 20 wherein the fluidizing stream is heated to a temperature in excess of the temperature of the particulate before being introduced into the fluidizing bed.

35. The apparatus for segregating particulate of claim 20 wherein the fluidizing streams are heated to a temperature in excess of the temperature that the particulate has before the particulate is introduced into the fluidizing bed and wherein the apparatus is used in a plant system that generates excess heat as a by-product and the excess heat is the source of heat for warming the fluidizing stream.

36. The apparatus for segregating particulate of claim 20 wherein the fluidizing bed includes a first stage and a second stage separated by a weir, the weir is positioned so that only fluidized particulate is directed by the fluidizing stream into the second stage, and the conveyor and non-fluidized particulate exit are both located within the first stage.

37. A method of segregating particulate by weight or size including:

(a) providing a fluidizing bed having a particulate receiving inlet for receiving particulate to be fluidized, an opening for receiving a first fluidizing stream, an exit for fluidized particulate and an exit for non-fluidized particulate;

(b) providing a conveyor for conveying the non-fluidized particulate in the fluidizing bed to the non-fluidized particulate exit;

(c) providing a collector box positioned to receive the non-fluidized particulate exiting the fluidizing bed, said collector box including means for directing a second fluidizing stream through the non-fluidized particulate as it is exits through the collector box to separate fluidizable particulate there from;

(d) providing a source of fluidizing streams operatively connected to the fluidizing bed and collector box; and (e) delivering particulate through the particulate receiving inlet of the fluidizing bed for processing.

38. The apparatus for segregating particulate of claim 20 wherein the exit for non-fluidized particulate includes a first opening through which the fluidizing stream from the collector box directs fluidized particulate back into the fluidizing bed and a second opening for removal of non-fluidized material from the fluidizing bed.

39. The apparatus for segregating particulate of claim 20 wherein the conveyor is an auger.

40. An apparatus for segregating particulate material by density and/or size to concentrate a contaminant for separation from the particulate material feed stream, comprising:

(a) a fluidizing bed having a receiving inlet for receiving the particulate material feed, an inlet opening for receiving a fluidizing stream, a discharge outlet for discharging a fluidized particulate material product stream, and a discharge outlet for discharging a non-fluidized particulate material stream; (b) a source of fluidizing stream operatively connected to the inlet opening for introducing the fluidizing stream into the fluidizing bed to achieve separation of the fluidized particulate material product stream from the non-fluidized particulate material stream;

(c) a conveyor means for transporting the non-fluidized particulate material inside the fluidized bed through the discharge outlet to a reception means; and (d) wherein the fluidized particulate material product stream contains a reduction in the contaminant relative to the particulate material feed stream, and the non-fluidized particulate material stream contains an increase in the contaminant relative to the particulate material feed stream.

41. The apparatus for segregating particulate of claim 40 further, wherein the fluidizing bed includes a first stage and a second stage separated by a weir, the weir is positioned so that only fluidized particulate is directed by the fluidizing stream into the second stage, and the conveyor means and non-fluidized particulate discharge outlet are both located within the first stage.

42. The apparatus for segregating particulate of claim 40 further comprising a bed distributor plate located near the bottom of the fluidizing bed for supporting particulate placed in the fluidizing bed, said distributor plate being arranged with a plurality of spaced, angled apertures creating multiple fluidizing streams within the bed for directing fluidizing streams through the particulate contained within the fluidizing bed.

* * * * *